US010961823B2

(12) United States Patent
Shampine

(10) Patent No.: US 10,961,823 B2
(45) Date of Patent: Mar. 30, 2021

(54) PRESSURE EXCHANGER PRESSURE OSCILLATION SOURCE

(71) Applicant: Schlumberger Technology Corporation, Sugar Land, TX (US)

(72) Inventor: Rod William Shampine, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 57 days.

(21) Appl. No.: 16/346,795

(22) PCT Filed: Nov. 6, 2017

(86) PCT No.: PCT/US2017/060081
§ 371 (c)(1),
(2) Date: May 1, 2019

(87) PCT Pub. No.: WO2018/085741
PCT Pub. Date: May 11, 2018

(65) Prior Publication Data

US 2020/0072025 A1 Mar. 5, 2020

Related U.S. Application Data

(60) Provisional application No. 62/417,629, filed on Nov. 4, 2016.

(51) Int. Cl.
*E21B 41/00* (2006.01)
*E21B 43/26* (2006.01)
(Continued)

(52) U.S. Cl.
CPC ..... *E21B 41/00* (2013.01); *E21B 43/26* (2013.01); *E21B 47/06* (2013.01); *E21B 47/18* (2013.01)

(58) Field of Classification Search
CPC ..... E21B 43/26; E21B 43/2607; E21B 41/00; E21B 47/06; E21B 47/18; E21B 33/13;
(Continued)

(56) References Cited

U.S. PATENT DOCUMENTS 5,259,731 A * 11/1993 Dhindsa ..... F04B 49/065 417/3
5,899,272 A 5/1999 Loree
(Continued)

FOREIGN PATENT DOCUMENTS

WO 2010071994 A1 7/2010
WO 2014074939 A1 5/2014
WO 2016176531 A1 11/2016

*Primary Examiner* — Brad Harcourt
(74) *Attorney, Agent, or Firm* — Rodney Warfford

(57) ABSTRACT

Apparatus and methods for utilizing pressure exchangers as a source of pressure oscillations. An example method includes operating a plurality of pressure exchangers to pressurize a stream of fluid, injecting the pressurized stream of fluid into a wellbore extending into a subterranean formation, and controlling rotational speed and rotational position of a rotor of each of the pressure exchangers to control amplitude and/or frequency of pressure oscillations within the pressurized stream of fluid being injected into the wellbore.

33 Claims, 13 Drawing Sheets

(51) Int. Cl.
*E21B 47/06* (2012.01)
*E21B 47/18* (2012.01)

(58) Field of Classification Search
CPC . F04F 13/00; F04B 11/00; F04B 15/02; F04B 23/06
See application file for complete search history.

(56) References Cited

U.S. PATENT DOCUMENTS

| | | | | |
|---|---|---|---|---|
| 5,935,490 | A | 8/1999 | Archbold et al. | |
| 2002/0146325 | A1 | 10/2002 | Shumway | |
| 2007/0023718 | A1 | 2/2007 | Menconi | |
| 2008/0087253 | A1 | 4/2008 | Cvengros et al. | |
| 2009/0180903 | A1 | 7/2009 | Martin et al. | |
| 2009/0301725 | A1 | 12/2009 | Case et al. | |
| 2010/0212156 | A1 | 8/2010 | Judge et al. | |
| 2011/0154802 | A1 | 6/2011 | Joshi et al. | |
| 2014/0048143 | A1 | 2/2014 | Lehner et al. | |
| 2014/0128655 | A1 | 5/2014 | Arluck et al. | |
| 2015/0050167 | A1 | 2/2015 | Hirosawa et al. | |
| 2015/0184492 | A1* | 7/2015 | Ghasripoor ..... | F04F 13/00 166/250.01 |
| 2016/0032702 | A1 | 2/2016 | Gay et al. | |
| 2016/0084269 | A1 | 3/2016 | Hauge | |
| 2016/0146229 | A1 | 5/2016 | Martin et al. | |
| 2016/0281487 | A1 | 9/2016 | Ghasripoor et al. | |
| 2017/0306987 | A1* | 10/2017 | Theodossiou ..... | E21B 43/126 |

* cited by examiner

PRESSURE EXCHANGER PRESSURE OSCILLATION SOURCE

CROSS-REFERENCE TO RELATED APPLICATIONS

This application claims the benefit of U.S. Provisional Patent Application No. 62/417,629, entitled "PRESSURE EXCHANGER ACOUSTIC SOURCE," filed Nov. 4, 2016, the entire disclosure of which is hereby incorporated herein by reference.

BACKGROUND OF THE DISCLOSURE

A variety of fluids are used in oil and gas operations. Fluids may be pumped into the subterranean formation through the use of one or more high-pressure pumps. Dirty fluids, such as solids-laden fluids containing insoluble abrasive solid particles, can reduce functional life and increase maintenance of the high-pressure pumps.

Pressure exchangers provide a way to exchange pressure energy between two fluid flows. An example pressure exchanger has a rotating rotor with multiple flow cavities, channels, or other chambers. The rotor rotates in a housing via a fluid-lubricated bearing. Disc valves at opposing ends of the pressure exchanger intermittently seal corresponding ends of the chambers between alternating passage of different ports of each disc valve. Fluid flow entering each chamber is directed along a small, off-axial vector, thus imparting rotation to the rotor.

As the rotor rotates, each chamber is in turn connected to a source of dirty fluid via a dirty fluid input port of one of the disc valves, such that the dirty fluid enters each chamber as the chamber passes the dirty fluid input port. As the rotor further rotates, each chamber is then connected to a source of high-pressure clean fluid via a clean fluid input port of one of the disc valves, such that the high-pressure clean fluid enters each chamber as the chamber passes the clean fluid input port, and an interface between the dirty fluid and the clean fluid is pushed away from the clean fluid input side, thus pressurizing and then ejecting the dirty fluid as further rotation causes the chamber to pass a dirty fluid discharge port of one of the disc valves. The now depressurized clean fluid may then be ejected as further rotation causes the chamber to pass a clean fluid discharge port of one of the disc valves. The cycle may be repeated continuously to form a continuous stream of pressurized dirty fluid.

In the application of rotary pressure exchangers in the field of hydraulic fracturing, cementing, drilling, and cuttings injection, the piping networks utilized during such operations comprise inherent or attendant resonant modes or frequencies. These modes are often excited by pressure oscillations (i.e., fluctuations, pulsations) generated by various wellsite equipment. During operation, the pressure exchangers generate attendant medium frequency pressure oscillations caused by the rotary valves (e.g., rotors) of the pressure exchangers. Such pressure oscillations may cause damage to the piping network and downstream tools and equipment.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus including a fluid pumping system having pressure exchangers and a controller. The pressure exchangers each include a fluid inlet, a fluid outlet, and a rotor disposed between the fluid inlet and the fluid outlet. The rotor includes fluid chambers extending therethrough. Each pressure exchanger is operable to receive a pressurized stream of first fluid into the chambers via the fluid inlet to pressurize and discharge a stream of second fluid out of the chambers via the fluid outlet. The pressurized stream of second fluid discharged via the fluid outlet of each of the pressure exchangers contains pressure oscillations having a frequency based on rotational speed of the corresponding rotor. The fluid outlets are fluidly connected together to form a combined pressurized stream of second fluid. The controller includes a processor and a memory operable to store a computer program code. The controller is operable to control rotational speed and rotational position of the rotor of each of the pressure exchangers to control the frequency and phase of the pressure oscillations within the pressurized stream of second fluid discharged via the fluid outlet of each of the pressure exchangers, and thus control amplitude and/or frequency of combined pressure oscillations within the combined pressurized stream of second fluid.

The present disclosure also introduces an apparatus including a wellsite system operable to inject a dirty fluid into a wellbore extending into a subterranean formation. The wellsite system includes a source of a pressurized clean fluid, a source of the dirty fluid, and multiple pressure exchangers. Each pressure exchanger includes a low-pressure fluid inlet, a high-pressure fluid inlet, a high-pressure fluid outlet, and a rotor having fluid chambers extending therethrough. As each rotor rotates, each pressure exchanger is operable to receive the dirty fluid into the chambers via the low-pressure fluid inlet, and to receive the pressurized clean fluid into the chambers via the high-pressure fluid inlet to pressurize and discharge the dirty fluid out of the chambers via the high-pressure fluid outlet. The pressurized dirty fluid discharged via the high-pressure fluid outlet of each of the pressure exchangers contains pressure oscillations having a frequency based on rotational speed of the corresponding rotor. The wellsite system also includes a manifold fluidly connecting the high-pressure fluid outlets to combine the pressurized dirty fluid discharged via the high-pressure fluid outlets of the pressure exchangers, a fluid conduit fluidly connecting the manifold with the wellbore to transfer the combined pressurized dirty fluid into the wellbore, and a controller including a processor and a memory operable to store a computer program code. The controller is operable to control rotational speed and rotational position of the rotor of each of the pressure exchangers to control the frequency and phase of the pressure oscillations within the pressurized dirty fluid discharged via the high-pressure fluid outlet of each of the pressure exchangers, and thus control amplitude and/or frequency of combined pressure oscillations within the combined pressurized dirty fluid.

The present disclosure also introduces a method including operating multiple rotary pressure exchangers to pressurize a stream of fluid, injecting the pressurized stream of fluid into a wellbore extending into a subterranean formation, and controlling rotational speed and rotational position of a rotor of each of the pressure exchangers to control amplitude and/or frequency of pressure oscillations within the pressurized stream of fluid being injected into the wellbore.

These and additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
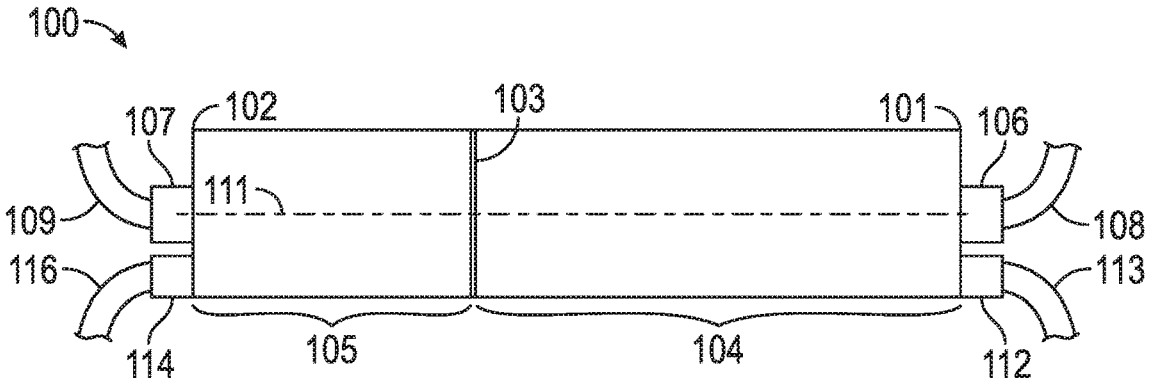
FIG. 1 is a schematic view of at least a portion of an example implementation of apparatus according to one or more aspects of the present disclosure.

It is to be understood that the following disclosure provides many different implementations, or examples, for implementing different features of various implementations. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various implementations described below. Moreover, the formation of a first feature over or on a second feature in the description that follows may include implementations in which the first and second features are formed in direct contact, and may also include implementations in which additional features may be formed interposing the first and second features, such that the first and second features may not be in direct contact. It should also be understood that the terms "first," "second," "third," etc., are arbitrarily assigned, are merely intended to differentiate between two or more parts, fluids, etc., and do not indicate a particular orientation or sequence.

The present disclosure introduces one or more aspects related to utilizing one or more pressure exchangers to divert a corrosive, abrasive, and/or solids-laden fluid (referred to herein as "dirty fluid") away from high-pressure pumps, instead of pumping such fluid with the high-pressure pumps. A non-corrosive, non-abrasive, and solids-free fluid (referred to herein as "clean fluid") may be pressurized by the high-pressure pumps, while the pressure exchangers, located downstream from the high-pressure pumps, transfer the pressure from the pressurized clean fluid to low-pressure dirty fluid. Such use of pressure exchangers may facilitate improved fluid control during well treatment operations and/or increased functional life of the high-pressure pumps and other wellsite equipment fluidly coupled between the high-pressure pumps and the pressure exchangers.

As used herein, a "fluid" is a substance that can flow and conform to the outline of its container when the substance is tested at a temperature of 71° F. (22° C.) and a pressure of one atmosphere (atm) (0.1 megapascals (MPa)). A fluid may be liquid, gas, or both. A fluid may be water based or oil based. A fluid may have just one phase or more than one distinct phase. A fluid may be a heterogeneous fluid having more than one distinct phase. Example heterogeneous fluids within the scope of the present disclosure include a solids-laden fluid or slurry (such as may comprise a continuous liquid phase and undissolved solid particles as a dispersed phase), an emulsion (such as may comprise a continuous liquid phase and at least one dispersed phase of immiscible liquid droplets), a foam (such as may comprise a continuous liquid phase and a dispersed gas phase), and a mist (such as may comprise a continuous gas phase and a dispersed liquid droplet phase), among other examples also within the scope of the present disclosure. A heterogeneous fluid may comprise more than one dispersed phase. Moreover, one or more of the phases of a heterogeneous fluid may be or comprise a mixture having multiple components, such as fluids containing dissolved materials and/or undissolved solids.

Plunger pumps may be employed in high-pressure oilfield pumping applications, such as for hydraulic fracturing ("frac") applications. Plunger pumps are often referred to as positive displacement pumps, intermittent duty pumps, triplex pumps, quintuplex pumps, or frac pumps, among other examples also within the scope of the present disclosure. Multiple plunger pumps may be employed simultaneously in large-scale operations, such as where tens of thousands of gallons of fluid are pumped into a wellbore. These pumps may be linked to each other with a manifold, such as may be plumbed to collect the output of the multiple pumps and direct it to the wellbore.

As described above, some fluids (e.g., fracturing fluid) may contain ingredients that are abrasive to the internal components of a pump. For example, a fracturing fluid generally contains proppant or other solid particulate material that is insoluble in a base fluid. To create fractures, the fracturing fluid may be pumped at high pressures ranging, for example, between about 5,000 and about 15,000 pounds force per square inch (psi) or more. The proppant may initiate the fractures and/or keep the fractures propped open. The propped fractures provide highly permeably flow paths for oil and gas to flow from the subterranean formation, thereby enhancing the production of a well formed in the formation. However, the abrasive fracturing fluid may accelerate wear of the internal components of the pumps. Consequently, the repair, replacement, and maintenance expenses of the pumps can be quite high, and life expectancy can be low.

Example implementations of apparatus described herein relate generally to a fluid system for forming and pressurizing a solids-laden fluid (e.g., fracturing fluid) having predetermined concentrations of solid material for injection into a wellbore during well treatment operations. The fluid system may include a blending or mixing device for receiving and mixing a solids-free carrying fluid or gel and a solid material to form the solids-laden fluid. The fluid system may also include a fluid pressure exchanger for increasing the pressure of or otherwise energizing the solids-laden fluid formed by the mixing device before being injected into the wellbore. The fluid pressure exchanger may be utilized to pressurize the solids-laden fluid by facilitating or permitting pressure from a pressurized solids-free fluid to be transferred to a low-pressure solids-laden fluid, among other uses. The fluid pressure exchanger may comprise one or more chambers into which the low-pressure, solids-laden fluid and the pressurized, solids-free fluid are conducted. The solids-free fluid may be conducted into the chamber at a higher pressure than the solids-laden fluid, and may thus be utilized to pressurize the solids-laden fluid. The pressurized, solids-laden fluid is then conducted from the chamber to a wellhead for injection into the wellbore. By pumping just the solids-free fluid with the pumps and utilizing the pressure exchanger to increase the pressure of the solids-laden fluid, the useful life of the pumps may be increased. Example implementations of methods described herein relate generally to utilizing the fluid system to form and pressure the solids-laden fluid for injection into the wellbore during well treatment operations.

FIG. 1 is a schematic view of an example implementation of a chamber 100 of a fluid pressure exchanger for pressurizing a dirty fluid with a clean fluid according to one or more aspects of the present disclosure. The chamber 100 includes a first end 101 and a second end 102. The chamber 100 may include a border or boundary 103 between the dirty and clean fluids defining a first volume 104 and a second volume 105 within the chamber 100. The boundary 103 may be a membrane that is impermeable or semi-permeable to a fluid, such as a gas. The membrane may be an impermeable membrane in implementations in which the dirty and clean fluids are incompatible fluids, or when mixing of the dirty and clean fluids is to be substantially prevented, such as to recycle the clean fluid absent contamination by the dirty fluid. The boundary 103 may be a semi-permeable membrane in implementations permitting some mixing of the clean fluid with the dirty fluid, such as to foam the dirty fluid when the clean fluid comprises a gas.

The boundary 103 may be a floating piston or separator slidably disposed along the chamber 100. The floating piston may physically isolate the dirty and clean fluids and be movable via pressure differential between the dirty and clean fluids. The floating piston may be retained within the chamber 100 by walls or other features of the chamber 100. The density of the floating piston may be set between that of the clean and dirty fluids, such as may cause gravity to locate the floating piston at an interface of the dirty and clean fluids when the chamber 100 is oriented vertically.

The boundary 103 may also be a diffusion or mixing zone in which the dirty and clean fluids mix or otherwise interact during pressurizing operations. The boundary 103 may also not exist, such that the first and second volumes 104 and 105 form a continuous volume within the chamber 100. A first inlet valve 106 is operable to conduct the dirty fluid into the first volume 104 of the chamber 100, and a second inlet valve 107 is operable to conduct the clean fluid into the second volume 105 of the chamber 100.

Figure 2:
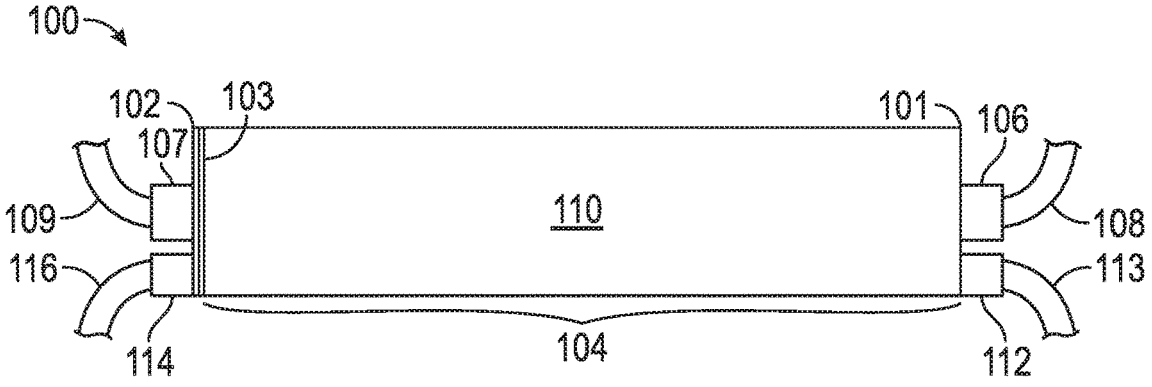
FIG. 2 is a schematic view of the apparatus shown in FIG. 1 in an operational stage according to one or more aspects of the present disclosure.

For example, FIG. 2 is a schematic view of the chamber 100 shown in FIG. 1 in an operational stage according to one or more aspects of the present disclosure, during which the dirty fluid 110 has been conducted into the chamber 100 through the first inlet valve 106 at the first end 101, such as via one or more fluid conduits 108. Consequently, the dirty fluid 110 may move the boundary 103 within the chamber 100 along a direction substantially parallel to the longitudinal axis 111 of the chamber 100, thereby increasing the first volume 104 and decreasing the second volume 105. The first inlet valve 106 may be closed after entry of the dirty fluid 110 into the chamber 100.

Figure 3:
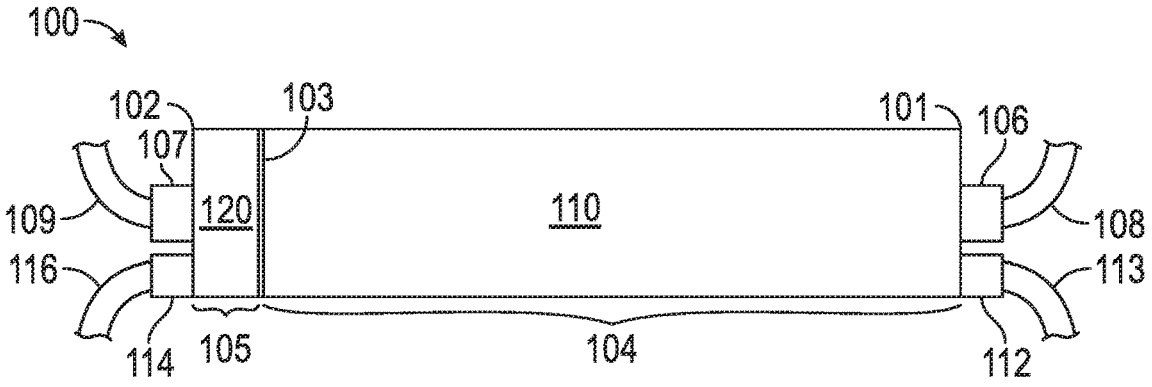
FIG. 3 is a schematic view of the apparatus shown in FIG. 2 in another operational stage according to one or more aspects of the present disclosure.

FIG. 3 is a schematic view of the chamber 100 shown in FIG. 2 in a subsequent operational stage according to one or more aspects of the present disclosure, during which a clean fluid 120 is being conducted into the chamber 100 through the second inlet valve 107 at the second end 102, such as via one or more fluid conduits 109. The clean fluid 120 may be conducted into the chamber 100 at a higher pressure compared to the pressure of the dirty fluid 110. Consequently, the higher-pressure clean fluid 120 may move the boundary 103 and the dirty fluid 110 within the chamber 100 back towards the first end 101, thereby reducing the volume of the first volume 104 and thereby pressurizing or otherwise energizing the dirty fluid 110. The clean fluid 120 may be a combustible or cryogenic gas that, upon combustion or heating, acts to pressurize the dirty fluid 110, whether instead of or in addition to the higher pressure of the clean fluid 120 acting to pressurize the dirty fluid 110. The boundary 103 and/or other components may include one or more burst discs to protect against overpressure from the clean fluid 120.

Figure 4:
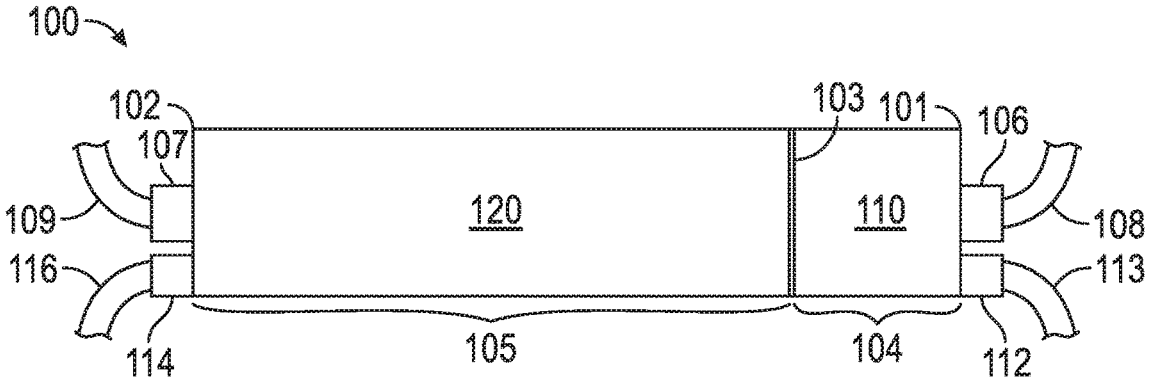
FIG. 4 is a schematic view of the apparatus shown in FIGS. 2 and 3 in another operational stage according to one or more aspects of the present disclosure.

As shown in FIG. 4, the boundary 103 may continue to reduce the first volume 104 as the pressurized dirty fluid 110 is conducted from the chamber 100 to a wellhead (not shown) at a higher pressure than when the dirty fluid 110 entered the chamber 100, such as via a first outlet valve 112 and one or more conduits 113. The second inlet valve 107 may then be closed, such as in response to pressure sensed by a pressure transducer within the chamber 100 and/or along one or more of the conduits and/or inlet valves.

After the pressurized dirty fluid 110 is discharged from the chamber 100, the clean fluid 120 may be drained via an outlet valve 114 at the second end 102 of the chamber 100 and one or more conduits 116. The discharged clean fluid 120 may be stored as waste fluid or reused during subsequent iterations of the fluid pressurizing process. For example, additional quantities of the dirty and clean fluids 110, 120 may then be introduced into the chamber 100 to repeat the pressurizing process to achieve a substantially continuous supply of pressurized dirty fluid 110.

Figure 5:
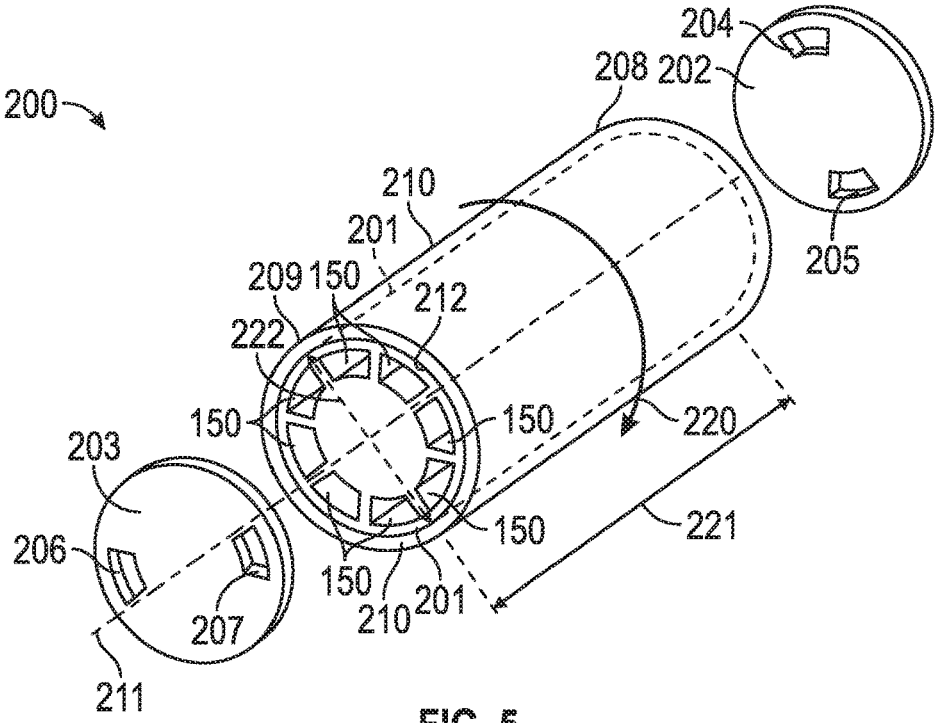
FIG. 5 is a partially exploded view of at least a portion of an example implementation of apparatus according to one or more aspects of the present disclosure.
Figure 6:
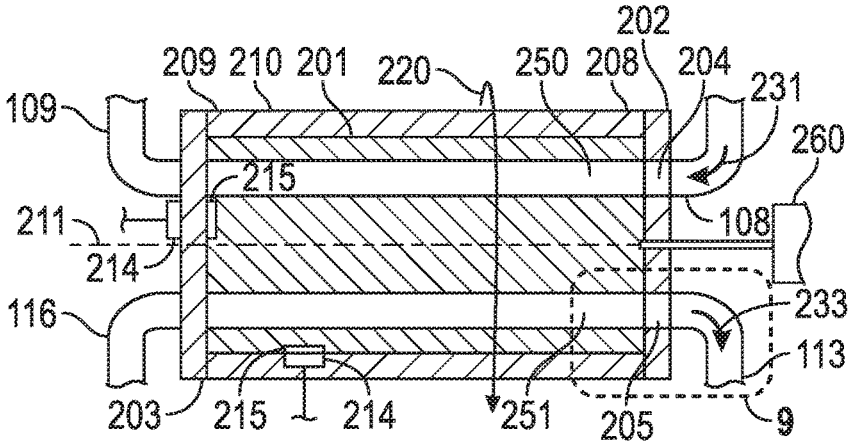
FIG. 6 is a sectional view of an example implementation of the apparatus shown in FIG. 5 according to one or more aspects of the present disclosure.
Figure 7:
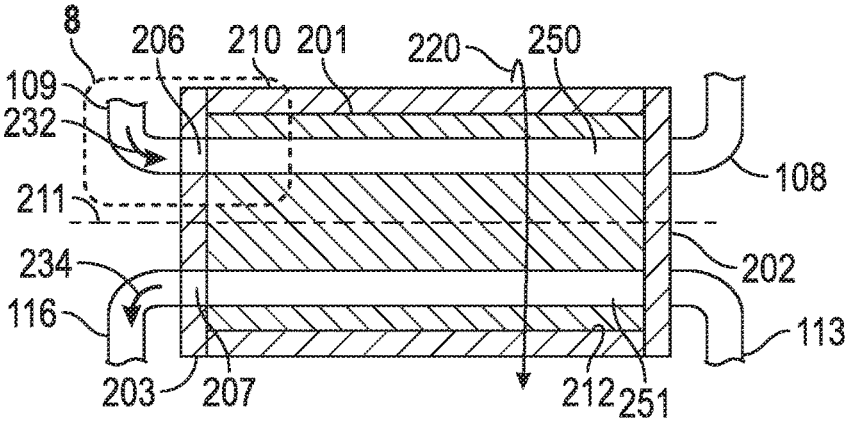
FIG. 7 is another view of the apparatus shown in FIG. 6 in a different stage of operation.

A fluid pressure exchanger comprising the apparatus shown in FIGS. 1-4 and/or others within the scope of the present disclosure may also comprise more than one of the example chambers 100 described above. FIG. 5 is a schematic view of an example fluid pressure exchanger 200 comprising multiple chambers 100 shown in FIGS. 1-4 and designated in FIG. 5 by reference numeral 150. FIGS. 6 and 7 are sectional views of the pressure exchanger 200 shown in FIG. 5. The following description refers to FIGS. 5-7, collectively.

The pressure exchanger 200 may comprise a housing 210 having a bore 212 extending between opposing ends 208, 209 of the housing 210. An end cap 202 may cover the bore 212 at the end 208 of the housing 210, and another end cap 203 may cover the bore 212 at the opposing end 209 of the housing 210. The housing 210 and the end caps 202, 203 may be sealingly engaged and statically disposed with respect to each other. The housing 210 and the end caps 202, 203 may be distinct components or members, or the housing 210 and one or both of the end caps 202, 203 may be formed as a single, integral, or continuous component or member. A rotor 201 may be slidably disposed within the bore 212 of the housing 210 and between the opposing end caps 202, 203 in a manner permitting relative rotation of the rotor 201 with respect to the housing 210 and end caps 202, 203. The rotor 201 may have a plurality of bores or chambers 150 extending through the rotor 201 and circumferentially spaced around an axis of rotation 211 extending longitudinally through the rotor 201. The rotor 201 may be a discrete member, as depicted in FIGS. 5-7, or an assembly of discrete components, such as may permit replacing worn portions of the rotor 201 and/or utilizing different materials for different portions of the rotor 201 to account for expected or actual wear.

The rotation of the rotor 201 about the axis 211 is depicted in FIG. 5 by arrow 220. Rotation of the rotor 201 may be achieved by various means. For example, rotation may be induced by utilizing force of the fluids received by the pressure exchanger 200, such as in implementations in which the fluids may be directed into the chambers 150 at a diagonal angle with respect to the axis of rotation 211, thereby imparting a rotational force to the rotor 201 to rotate the rotor 201. Rotation may also be achieved by a longitudinal geometry or configuring of at least a portion of the chambers 150 as they extend through the rotor 201. For example, an inlet portion of each chamber 150, or the entirety of each chamber 150, may extend in a helical manner with respect to the axis of rotation 211, such that the incoming stream of clean fluid imparts a rotational force to the rotor 201 to rotate the rotor 201.

Rotation may also be imparted via a motor 260 operably connected to the rotor 201. For example, the motor 260 may be an electrical or fluid powered motor connected with the rotor 201 via a shaft, a transmission, and/or other intermediate driving members, such as may extend through at least one of the end caps 202, 203 and/or the housing 210, to transfer torque to the rotor 201 to rotate the rotor 201. The motor 260 may also be connected with the rotor 201 via a magnetic shaft coupling, such as in implementations in which a driven magnet may be physically connected with the rotor 201, and a driving magnet may be located outside of the pressure exchanger 200 and magnetically connected with the driven magnet. Such implementations may permit the motor 260 to drive the rotor 201 without a shaft extending through the end caps 202, 203 and/or housing 210.

Rotation may also be imparted into the rotor 201 via an electrical motor (not shown) disposed about and connected with the rotor 201. For example, the electrical motor may comprise an electrical stator disposed about or included as part of the housing 210, and an electrical rotor connected about or included as part of the rotor 201. The electrical stator may comprise field coils or windings that generate a magnetic field when powered by electric current from a source of electric power. The electrical rotor may comprise windings or permanent magnets fixedly disposed about or included as part of the rotor 201. The electrical stator may surround the electrical rotor in a manner permitting rotation of the rotor 201/electrical rotor assembly within the housing 210/electrical stator assembly during operation of the electrical motor. The electrical motors utilized within the scope of the present disclosure may include, for example, synchronous and asynchronous electric motors.

The pressure exchanger 200 may also comprise means for sensing or otherwise determining the rotational speed of the rotor 201. For example, the rotor speed sensing means may comprise one or more sensors 214 associated the rotor 201 and operable to convert position or presence of a rotating or otherwise moving portion of the rotor 201, a feature of the rotor 201, or a marker 215 disposed in association with the rotor 201, into an electrical signal or information related to or indicative of the position and/or speed of the rotor 201. Each sensor 214 may be disposed adjacent the rotor 201 or otherwise disposed in association with the rotor 201 in a manner permitting sensing of the rotor or the marker 215 during pressurizing operations.

Each sensor 214 may sense one or more magnets on the rotor 201, one or more features on the rotor 201 that can be optically detected, conductive portions or members on the rotor 201 that can be sensed with an electromagnetic sensor, and/or facets or features on the rotor 201 that can be detected with an ultrasonic sensor, among other examples. Each sensor 214 may be or comprise a linear encoder, a capacitive sensor, an inductive sensor, a magnetic sensor, a Hall effect sensor, and/or a reed switch, among other examples. The speed sensing means may also include an intentionally imbalanced rotor 201 whose vibrations may be detected with an accelerometer and utilized to determine the rotational speed of the rotor 201.

The sensors 214 may extend through the housing 210, the end caps 202, 203, or another pressure barrier fluidly isolating the internal portion of the pressure exchanger 201 in a manner permitting the detection of the presence of the rotor 201 or the marker 215 at a selected or predetermined position. The sensor 214 and/or an electrical conductor connected with the sensor 214 may be sealed against the pressure barrier, such as to prevent or minimize fluid leakage. However, a non-magnetic housing 210 and/or end caps 202, 203 may be utilized, such as may permit a magnetic field to pass therethrough and, thus, permit the sensors 214 to be disposed on the outside of the housing 210 and/or end caps 202, 203. The sensor 214 may also be an ultrasonic transducer operable to send a pressure wave through the housing 210 and into the rotor 201, such as in implementations in which the housing 210 is a steel housing and the rotor 201 is a ceramic stator. The pressure wave may be reflected from varying markers or portions of the rotor 201 and sensed by the ultrasonic transducer to determine the rotational speed of the rotor 201.

The end caps 202, 203 may functionally replace the valves 106, 107, 112, and 114 depicted in FIGS. 1-4. For example, the first end cap 202 may be substantially disc-shaped, or may comprise a substantially disc-shaped portion, through which an inlet 204 and an outlet 205 extend. The inlet 204 may act as the first inlet valve 106 shown in FIGS. 1-4, and the outlet 205 may act as the first outlet valve 112 shown in FIGS. 1-4. Similarly, the second end cap 203 may be substantially disc-shaped, or may comprise a substantially disc-shaped portion, through which an inlet 206 and an outlet 207 extend. The inlet 206 may act as the second inlet valve 107 shown in FIGS. 1-4, and the outlet 207 may act as the second outlet valve 114 shown in FIGS. 1-4. The fluid inlets and outlets 204-207 may have a variety of dimensions and shapes. For example, as in the example implementation depicted in FIG. 5, the inlets and outlets 204-207 may have dimensions and shapes substantially corresponding to the cross-sectional dimensions and shapes of the openings of each chamber 150 at the opposing ends of the rotor 201. However, other implementations are also within the scope of the present disclosure, provided that the chambers 150 may each be sealed against the end caps 202, 203 in a manner preventing or minimizing fluid leaks. For example, the surfaces of the end caps 202, 203 that mate with the corresponding ends of the rotor 201 may comprise face seals and/or other sealing means.

In the example implementation depicted in FIG. 5, the rotor 201 comprises eight chambers 150. However, other implementations within the scope of the present disclosure may comprise as few as two chambers 150, or as many as several dozen. The rotational speed of the rotor 201 may also vary, and may be timed as per the velocity of the boundary 103 between the dirty and clean fluids and the length 221 of the chambers 150 so that the timing of the inlets and outlets 204-207 are adjusted in order to facilitate proper functioning as described herein. The rotational speed of the rotor 201 may be based on the intended flow rate of the pressurized dirty fluid exiting the chambers 150 collectively, the amount of pressure differential between the dirty and clean fluids, and/or the dimensions of the chambers 150. For example, larger dimensions of the chambers 150 and greater rotational speed of the rotor 201 relative to the end caps 202, 203 and housing 210 will increase the discharge volume of the pressurized dirty fluid.

The size and number of instances of the fluid pressure exchanger 200 utilized at a wellsite in oil and gas operations may depend on the location of the fluid pressure exchanger 200 within the process flow stream at the wellsite. For example, some oil and gas operations at a wellsite may utilize multiple pumps (such as the pumps 306 shown in FIG. 11) that each receive low-pressure dirty fluid from a common manifold (such as the manifold 308 shown in FIG. 11) and then pressurize the dirty fluid for return to the manifold. For such operations, an instance of the fluid pressure exchanger 200 may be utilized between each pump and the manifold, and/or one or more instances of the fluid pressure exchanger 200 may replace one or more of the pumps. In such implementations, the rotor 201 may have a length 221 ranging between about 25 centimeters (cm) and about 150 cm and a diameter 222 ranging between about 10 cm and about 30 cm, the cross-sectional area (flow area) of each chamber 150 may range between about 5 $cm^2$ and about 20 $cm^2$, and/or the volume of each chamber 150 may range between about 75 cubic cm (cc) and about 2500 cc. However, other dimensions are also within the scope of the present disclosure. Some oil and gas operations at a wellsite may utilize multiple pumps that each receive low-pressure dirty fluid directly from a corresponding mixer (such as the mixer 304 shown in FIG. 11) or another source of dirty fluid, and then pressurize the dirty fluid for injection directly into a well (such as the well 311 shown in FIG. 11). For such operations, an instance of the fluid pressure exchanger 200 may be utilized between each pump and the well, and/or one or more instances of the fluid pressure exchanger 200 may replace one or more of the pumps.

In some implementations, the pumps may each receive low-pressure clean fluid from the manifold (such as may be received at the manifold from a secondary fluid source) and then pressurize the clean fluid for return to the manifold. The pressurized clean fluid may then be conducted from the manifold to one or more instances of the fluid pressure exchanger 200 to be utilized to pressurize low-pressure dirty fluid received from a gel maker, proppant blender, and/or other low-pressure processing device, and the pressurized dirty fluid discharged from the fluid pressure exchanger(s) 200 may be conducted towards a well. Examples of such operations include those shown in FIGS. 12-18, among other examples within the scope of the present disclosure. In such implementations, the length 221 of the rotor 201, the diameter 222 of the rotor 201, the flow area of each chamber 150, the volume of each chamber 150, and/or the number of chambers 150 may be much larger than as described above.

FIG. 6 is a sectional view of the pressure exchanger 200 shown in FIG. 5 during an operational stage in which two of the chambers are substantially aligned with the inlet and outlet 204, 205 of the first end cap 202 but not with the inlet and outlet 206, 207 of the second end cap 203. Thus, the inlet 204 fluidly connects one of the depicted chambers 150, designated by reference number 250 in FIG. 6, with the one or more conduits 108 supplying the non-pressurized dirty fluid, such that the non-pressurized dirty fluid may be conducted into the chamber 250. At the same time, the outlet 205 fluidly connects another of the depicted chambers 150, designated by reference number 251 in FIG. 6, with the one or more conduits 113 conducting previously pressurized dirty fluid out of the chamber 251, such as for conduction into a wellbore (not shown). As the rotor 201 rotates relative to the end caps 202, 203, the chambers 250, 251 will rotate out of alignment with the inlet and outlet 204, 205, thus preventing fluid communication between the chambers 250, 251 and the respective conduits 108, 113.

FIG. 7 is another view of the apparatus shown in FIG. 6 during another operational stage in which the chambers 250, 251 are substantially aligned with the inlet and outlet 206, 207 of the second end cap 203 but not with the inlet and outlet 204, 205 of the first end cap 202. Thus, the inlet 206 fluidly connects the chamber 250 with the one or more conduits 109 supplying the pressurizing or energizing clean fluid, such that the clean fluid may be conducted into the chamber 250. At the same time, the outlet 207 fluidly connects the other chamber 251 with the one or more conduits 116 conducting previously used, pressurizing, clean fluid out of the chamber 251, such as for recirculation to the clean fluid source (not shown). As the rotor 201 further rotates relative to the end caps 202, 203 and the housing 210, the chambers 250, 251 will rotate out of alignment with the inlet and outlet 206, 207, thus preventing fluid communication between the chambers 250, 251 and the respective conduits 109, 116.

The pressurizing process described above with respect to FIGS. 1-4 is achieved within each chamber 150, 250, 251 with each full rotation of the rotor 201 relative to the end caps 202, 203. For example, as the rotor 201 rotates relative to the end caps 202, 203 and the housing 210, the non-pressurized dirty fluid is conducted into the chamber 250 during the portion of the rotation in which the chamber 250 is in fluid communication with inlet 204 of the first end cap 202, as indicated in FIG. 6 by arrow 231. The rotation is continuous, such that the flow rate of non-pressurized dirty fluid into the chamber 250 increases as the chamber 250 comes into alignment with the inlet 204, and then decreases as the chamber 250 rotates out of alignment with the inlet 204. Further rotation of the rotor 201 relative to the end caps 202, 203 permits the pressurizing clean fluid to be conducted into the chamber 250 during the portion of the rotation in which the chamber 250 is in fluid communication with the inlet 206 of the second end cap 203, as indicated in FIG. 7 by arrow 232. The influx of the pressurizing clean fluid into the chamber 250 pressurizes the dirty fluid, such as due to the pressure differential between the dirty and clean fluids described above with respect to FIGS. 1-4.

Further rotation of the rotor 201 relative to the end caps 202, 203 and the housing 210 permits the pressurized dirty fluid to be conducted out of the chamber 250 during the portion of the rotation in which the chamber 250 is in fluid communication with the outlet 205 of the first end cap 202, as indicated in FIG. 6 by arrow 233. The discharged fluid may substantially comprise just the (pressurized) dirty fluid or a mixture of the dirty and clean fluids (also pressurized), depending on the timing of the rotor 201 and perhaps whether the chambers include the boundary 103 shown in FIGS. 1-4. Further rotation of the rotor 201 relative to the end caps 202, 203 permits the reduced-pressure clean fluid to be conducted out of the chamber 250 during the portion of the rotation in which the chamber 250 is in fluid communication with the outlet 207 of the second end cap 203, as indicated in FIG. 7 by arrow 234. The pressurizing process then repeats as the rotor 201 further rotates and the chamber 250 again comes into alignment with the inlet 204 of the first end cap 202.

Depending on the number and size of the chambers 150, the non-pressurized dirty fluid inlet 204 and the pressurizing clean fluid inlet 206 may be wholly or partially misaligned with each other about the central axis 211, such that the dirty fluid may be conducted into the chamber 150 to entirely or mostly fill the chamber 150 before the clean fluid is conducted into that chamber 150. The non-pressurized dirty fluid inlet 204 is completely closed to fluid flow from the conduit 108 before the pressurizing clean fluid inlet 206 begins opening. The pressurized dirty fluid outlet 205 and the reduced-pressure clean fluid outlet 207, however, may be partially open when the pressurizing clean fluid inlet 206 is permitting the clean fluid into the chamber 150. Similarly, the non-pressurized dirty fluid inlet 204 may be partially open when the pressurized dirty fluid outlet 205 and/or the reduced-pressure clean fluid outlet 207 is at least partially open.

The pressurized dirty fluid outlet 205 and the reduced-pressure clean fluid outlet 207 may be wholly or partially misaligned with each other about the central axis 211. For example, the pressurized dirty fluid (and perhaps a pressurized mixture of the dirty and clean fluids) may be substantially discharged from a chamber 150 via the pressurized dirty fluid outlet 205 before the remaining reduced-pressure clean fluid is permitted to exit through the reduced-pressure clean fluid outlet 207. As the rotor 201 continues to rotate relative to the end caps 202, 203 and the housing 210, the pressurized dirty fluid outlet 205 becomes closed to fluid flow, and the reduced-pressure clean fluid outlet 207 becomes open to discharge the remaining reduced-pressure clean fluid. Thus, the reduced-pressure clean fluid outlet 207 may be completely closed to fluid flow while the pressurized dirty fluid (or mixture of the dirty and clean fluids) is discharged from the chamber 150 to the wellhead. Complete closure of the reduced-pressure clean fluid outlet 207 may permit the pressurized fluid to maintain a higher-pressure flow to the wellhead.

The inlets and outlets 204-207 may also be configured to permit fluid flow into and out of more than one chamber 150 at a time. For example, the non-pressurized dirty fluid inlet 204 may be sized to simultaneously fill more than one chamber 150, the inlet and outlets 204-207 may be configured to permit non-pressurized dirty fluid to be conducted into a chamber 150 while the reduced-pressure clean fluid is simultaneously being discharged from that chamber 150. Depending on the size of the rotor 201 and the chambers 150, the fluid properties of the dirty and clean fluids, and the rotational speed of the rotor 201 relative to the end caps 202, 203, the pressurizing process within each chamber 150 may also be achieved in less than one rotation of the rotor 201 relative to the end caps 202, 203 and the housing 210, such as in implementations in which two, three, or more iterations of the pressurizing process is achieved within each chamber 150 during a single rotation of the rotor 201.

The flow of dirty fluid out of the pressure exchanger 200 via the fluid conduit 116 may be prevented or otherwise minimized by controlling the timing of the opening and closing of the fluid inlets 204, 206 and outlets 205, 207 of the pressure exchanger 200. For example, during the pressurizing operations, as the chambers 150 rotate, each chamber 150 is in turn aligned and, thus, fluidly connected with the low-pressure inlet 204 to receive the dirty fluid and the low-pressure outlet 207 to discharge the clean fluid. As the dirty fluid fills the chamber 150, the boundary 103 moves toward the low-pressure outlet 207 as the clean fluid is pushed out of the chamber 150. However, the rotation of the rotor 201 seals off the outlet 207 of the chamber 150 when or just before the boundary 103 reaches the outlet 207 to prevent or minimize the dirty fluid from entering into the fluid conduit 116. The chamber 150 then becomes aligned with the high-pressure inlet 206 and the high-pressure outlet 205 to permit the high-pressure clean fluid to enter the chamber 150 via the inlet 206 to push the dirty fluid from the chamber 150 via the outlet 205 at an increased pressure. As the clean fluid fills the chamber 150, the boundary 103 moves toward the high-pressure outlet 205 as the dirty fluid is pushed out of the chamber 150. However, the rotation of the rotor 201 seals off the outlet 205 of the chamber 150 when or just before the boundary 103 reaches the outlet 205 to prevent or minimize the clean fluid from entering into the fluid conduit 113. The clean fluid left in the chamber 150 may be pushed out through the fluid conduit 116 by the dirty fluid when the chamber 150 again becomes aligned with the low-pressure inlet 204 to receive the dirty fluid and the low-pressure outlet 207 to discharge the clean fluid. Such cycle may be continuously repeated to continuously receive and pressurize the stream of dirty fluid to form a substantially continuous or uninterrupted stream of dirty fluid.

Figure 8:
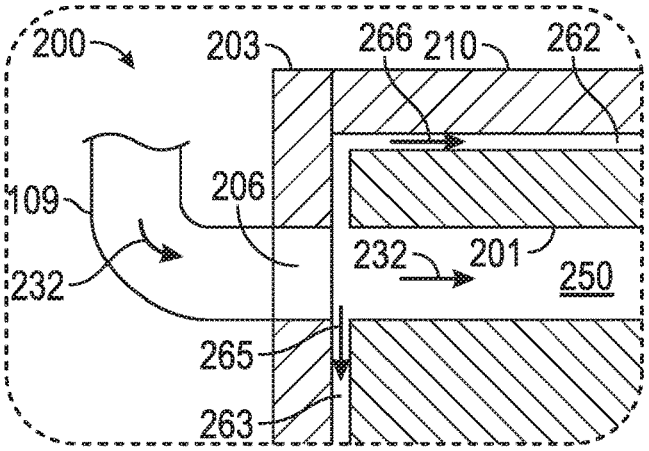
FIG. 8 is an enlarged view of the apparatus shown in FIG. 7 according to one or more aspects of the present disclosure.
Figure 9:
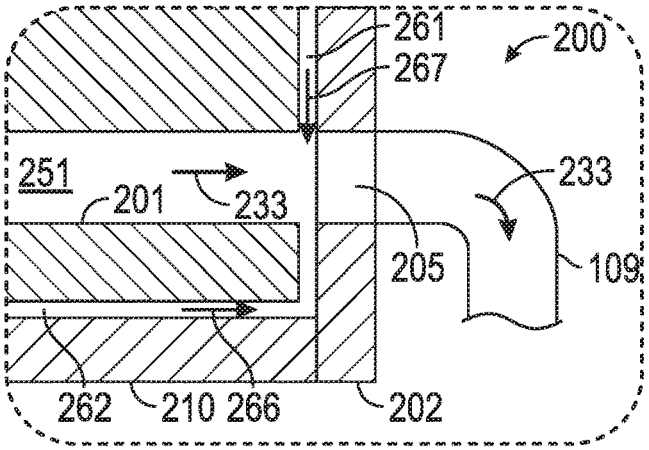
FIG. 9 is an enlarged view of the apparatus shown in FIG. 6 according to one or more aspects of the present disclosure.

FIGS. 8 and 9 are enlarged views of portions of the pressure exchanger 200 shown in FIGS. 7 and 6, respectively, according to one or more aspects of the present disclosure. The following description refers to FIGS. 6-9, collectively.

Small gaps or spaces 261, 262, 263 may be maintained between the rotor 201 and the housing 210, and between the rotor 201 and the end caps 202, 203, to permit rotation of the rotor 201 within the housing 210 and the end caps 202, 203. For clarity, the housing 210 and the end caps 202, 203 may be collectively referred to hereinafter as a "housing assembly." The spaces 261, 262, 263 may permit fluid flow between the rotor 201 and the housing assembly. For example, dirty fluid within the pressure exchanger 200 may flow through the space 261 along the end cap 202 from the high-pressure outlet 205 to the low-pressure fluid inlet 204, and through the spaces 261, 262, 263 along the housing 210 and the end caps 202, 203 from the high-pressure outlet 205 to the clean fluid low-pressure outlet 207. Clean fluid within the pressure exchanger 200 may flow through the space 263 along the end cap 203 from the high-pressure inlet 206 to the low-pressure outlet 207, as indicated by arrow 265, and through the spaces 261, 262, 263 along the housing 210 and the end caps 202, 203 from the high-pressure inlet 206 to the dirty fluid inlet and outlet 204, 205, as indicated by arrows 265, 266, 267.

The fluid flow through the spaces 261, 262, 263 within the pressure exchanger 200 may form a fluid film or layer operating as a hydraulic bearing and/or otherwise providing lubrication between the rotating rotor 201 and the static housing assembly, such as may prevent or reduce contact or friction between the rotor 201 and the housing assembly during pressurizing operations. The flow of fluids through the spaces 261, 262, 263 may be biased such that substantially just the clean fluid, and not the dirty fluid, flows through the spaces 261, 262, 263 during pressurizing operations, as indicated by arrows 265, 266, 267. Biasing the flow of clean fluid through the spaces 261, 262, 263 may also cause the clean/dirty fluid boundary 103 (shown in FIGS. 1-4) to maintain a net velocity directed toward the dirty fluid outlet 205. Accordingly, biasing the flow of clean fluid may result in substantially just the clean fluid being communicated through the spaces 261, 262, 263, such as to prevent or minimize friction or wear caused by the dirty fluid between the rotor 201 and the housing assembly. Biasing the flow of the clean fluid may also result in substantially just the clean fluid being discharged via the clean fluid outlet 207, such as to prevent or minimize contamination of the clean fluid discharged from the pressure exchanger 200. The apparatus and method implemented to bias the flow of clean fluid through the spaces 261, 262, 263 is further described below.

Figure 10:
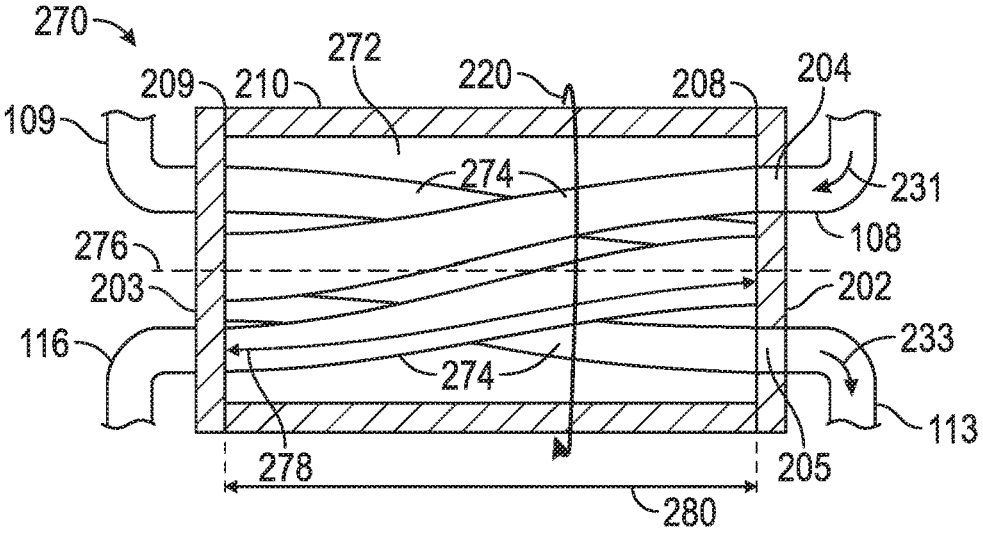
FIG. 10 is a sectional view of another example implementation of the apparatus shown in FIG. 5 according to one or more aspects of the present disclosure.

FIG. 10 is a sectional view of another example implementation of the pressure exchanger 200 shown in FIG. 5 according to one or more aspects of the present disclosure and designated in FIG. 10 by reference numeral 270. The pressure exchanger 270 is substantially similar in structure and operation to the pressure exchanger 200, including where indicated by like reference numbers, except as described below.

The pressure exchanger 270 may include a rotor 272 slidably disposed within the bore of the housing 210 and between the opposing end caps 202, 203 in a manner permitting relative rotation of the rotor 272 with respect to the housing 210 and the end caps 202, 203. The rotor 272 may have multiple bores or chambers 274 extending through the rotor 272 between the opposing ends 208, 209 of the housing 210 and circumferentially spaced around an axis of rotation 276 extending longitudinally along the rotor 272. For the sake of clarity, cross-hatching of the rotor 272 is removed from FIG. 10, and just four chambers 274 are depicted, it being understood that other chambers 274 may also exist.

The chambers 274 extend through the rotor 272 in a helical manner about or otherwise with respect to the axis of rotation 276. As described above, such helical chamber implementations may be utilized to impart rotation to the rotor 272 instead of with a separate motor 260 or other rotary driving means. Such helical chamber implementations may also permit the length 278 of the chambers 274 to be greater than the axial length 280 of the rotor 272, which may permit the axial length 280 of the rotor 272 to be reduced. The increased length 278 of the chambers 274 may also permit the rotor 272 to be rotated at slower speeds than a rotor having chambers that extend substantially parallel with respect to the axis of rotation.

The pressure exchangers 200, 270 shown in FIGS. 5-10 and/or otherwise within the scope of the present disclosure may utilize various forms of the dirty and clean fluids described above. For example, the dirty fluid may be a high-density and/or high-viscosity, solids-laden fluid comprising insoluble solid particulate material and/or other ingredients that may compromise the life or maintenance of pumps disposed downstream of the fluid pressure exchangers 200, 270, especially when such pumps are operated at higher pressures. Examples of the dirty fluid utilized in oil and gas operations may include treatment fluid, drilling fluid, spacer fluid, workover fluid, a cement composition, fracturing fluid, acidizing fluid, stimulation fluid, and/or combinations thereof, among other examples also within the scope of the present disclosure. The dirty fluid may be a foam, a slurry, an emulsion, or a compressible gas. The viscosity of the dirty fluid may be sufficient to permit transport of solid additives or other solid particulate material (collectively referred to hereinafter as "solids") without appreciable settling or segregation. Chemicals, such as biopolymers (e.g. polysaccharides), synthetic polymers (e.g. polyacrylamide and its derivatives), crosslinkers, viscoelastic surfactants, oil gelling agents, low molecular weight organogelators, and phosphate esters, may also be included in the dirty fluid, such as to control viscosity of the dirty fluid.

The composition of the clean fluid may permit the clean fluid to be pumped at higher pressures with reduced adverse effects on the downstream and/or other pumps. For example, the clean fluid may be a solids-free fluid that does not include insoluble solid particulate material or other abrasive ingredients, or a fluid that includes low concentrations of insoluble solid particulate material or other abrasive ingredients. The clean fluid may be a liquid, such as water (including freshwater, brackish water, or brine), a gas (including a cryogenic gas), or combinations thereof. The clean fluid may also include substances, such as tracers, that can be transferred to the dirty fluid upon mixing within the chambers 150, 250, 274, or upon transmission through a semi-permeable implementation of the boundary 103. The viscosity of the clean fluid may also be increased, such as to minimize or reduce viscosity contrast between the dirty and clean fluids. Viscosity contrast may result in channeling of the lower viscosity fluid through the higher viscosity fluid. The clean fluid may be viscosified utilizing the same chemicals and/or techniques described above with respect to the dirty fluid.

The clean and/or dirty fluid may be chemically modified, such as via one or more fluid additives temporarily (or regularly) injected into the clean and/or dirty fluids to produce a reaction at the clean/dirty boundary 103 that acts to stabilize the boundary 103 (e.g., a membrane, mixing zone). For example, viscosity modification may be utilized to help form a substantially flat flow profile within the chambers 150, 250, 274. Also, one or repeated pulses of a crosslinker applied to the clean fluid may be utilized to form crosslinked gel pills in the chambers 150, 250, 274 to act as boundary stabilizers. Such stabilizers may be safely pumped into the well and replaced over time.

Furthermore, the clean and dirty fluids may be selected or formulated such that a reaction between the clean and dirty fluids creates a physical change at the clean/dirty boundary 103 that stabilizes the boundary 103. For example, the clean and dirty fluids may crosslink when interacting at the boundary 103 to produce a floating, viscous plug. The clean and dirty fluids may be formulated such that the plug or another product of such reaction may not damage downstream components when trimmed off and injected into the well by the action of the outlet 205 or another discharge valve.

The following are additional examples of the dirty and clean fluids that may be utilized during oil and gas operations. However, the following are merely examples, and are not considered to be limiting to the dirty and clean fluids and that may also be utilized within the scope of the present disclosure.

For fracturing operations, the dirty fluid may be a slurry, with a continuous phase comprising water, and a dispersed phase comprising proppant (including foamed slurries), including implementations in which the dispersed proppant includes two or more different size ranges and/or shapes, such as may optimize the amount of packing volume within the fractures. The dirty fluid may also be a cement composition (including foamed cements), or a compressible gas. For such fracturing implementations, the clean fluid may be a liquid comprising water, a foam comprising water and gas, a gas, a mist, or a cryogenic gas.

For cementing operations, including squeeze cementing, the dirty fluid may be a cement composition comprising water as a continuous phase and cement as a dispersed phase, or a foamed cement composition. For such cementing implementations, the clean fluid may be a liquid comprising water, a foam comprising water and gas, a gas, a mist, or a cryogenic gas.

For drilling, workover, acidizing, and other wellbore operations, the dirty fluid may be a homogenous solution comprising water, soluble salts, and other soluble additives, a slurry with a continuous phase comprising water and a dispersed phase comprising additives that are insoluble in the continuous phase, an emulsion or invert emulsion comprising water and a hydrocarbon liquid, or a foam of one or more of these examples. In such implementations, the clean fluid may be a liquid comprising water, a foam comprising water and gas, a gas, a mist, or a cryogenic gas.

In the above example implementations, and/or others within the scope of the present disclosure, the dirty fluid 110 may include proppant; swellable or non-swellable fibers; a curable resin; a tackifying agent; a lost-circulation material; a suspending agent; a viscosifier; a filtration control agent; a shale stabilizer; a weighting agent; a pH buffer; an emulsifier; an emulsifier activator; a dispersion aid; a corrosion inhibitor; an emulsion thinner; an emulsion thickener; a gelling agent; a surfactant; a foaming agent; a gas; a breaker; a biocide; a chelating agent; a scale inhibitor; a gas hydrate inhibitor; a mutual solvent; an oxidizer; a reducer; a friction reducer; a clay stabilizing agent; an oxygen scavenger; cement; a strength retrogression inhibitor; a fluid loss additive; a cement set retarder; a cement set accelerator; a light-weight additive; a de-foaming agent; an elastomer; a mechanical property enhancing additive; a gas migration control additive; a thixotropic additive; and/or combinations thereof.

Figure 11:
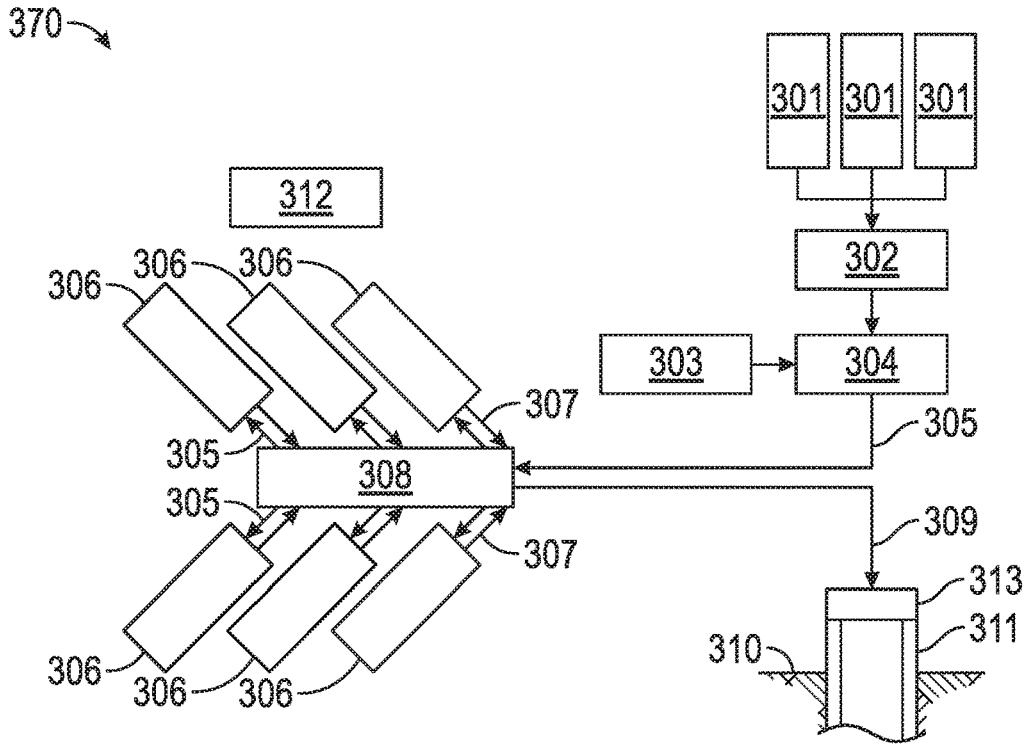
FIG. 11 is a schematic view of at least a portion of an example implementation of apparatus according to one or more aspects of the present disclosure.

FIG. 11 is a schematic view of an example wellsite system 370 that may be utilized for pumping a fluid from a wellsite surface 310 to a well 311 during a well treatment operation. Water from one or more water tanks 301 may be substantially continuously pumped to a gel maker 302, which mixes the water with a gelling agent to form a carrying fluid or gel, which may be a clean fluid. The gel may be substantially continuously pumped into a blending/mixing device, hereinafter referred to as a mixer 304. Solids, such as proppant and/or other solid additives stored in one or more solids containers 303, may be intermittently or substantially continuously pumped into the mixer 304 to be mixed with the gel to form a substantially continuous stream or supply of treatment fluid, which may be a dirty fluid. The treatment fluid may be pumped from the mixer 304 to a plurality of plunger, frac, and/or other pumps 306 through a system of conduits 305 and a manifold 308. Each pump 306 pressurizes the treatment fluid, which is then returned to the manifold 308 through another system of conduits 307. The stream of treatment fluid is then directed to the well 311 via a wellhead 313 through a system of conduits 309. A control unit 312 may be operable to control various portions of such processing via wired and/or wireless communications (not shown).

Figure 12:
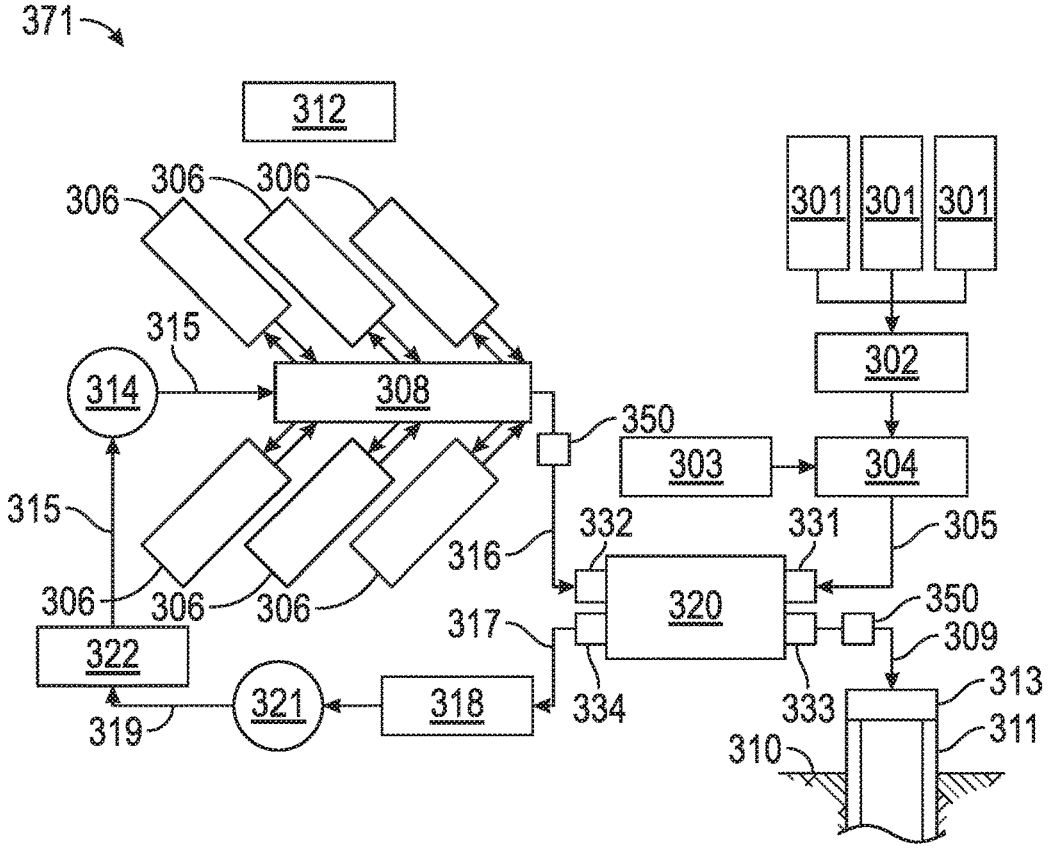
FIG. 12 is a schematic view of at least a portion of an example implementation of apparatus according to one or more aspects of the present disclosure.

FIG. 12 is a schematic view of an example implementation of another wellsite system 371 according to one or more aspects of the present disclosure. The wellsite system 371 comprises one or more similar features of the wellsite system 370 shown in FIG. 11, including where indicated by like reference numbers, except as described below.

The wellsite system 371 includes a fluid pressure exchanger 320, which may be utilized to eliminate or reduce pumping of dirty fluid through the pumps 306. The dirty fluid may be conducted from the mixer 304 to one or more chambers 100/150/250/251/274 of the fluid pressure exchanger 320 via the conduit system 305. The fluid pressure exchanger 320 may be, comprise, and/or otherwise have one or more aspects in common with the apparatus shown in one or more of FIGS. 1-10. Thus, as similarly described above with respect to FIGS. 1-10, the fluid pressure exchanger 320 comprises a non-pressurized dirty fluid inlet 331, a pressurized clean fluid inlet 332, a pressurized fluid discharge or outlet 333, and a reduced-pressure fluid discharge or outlet 334. Consequently, the pumps 306 may conduct the clean fluid to and from the manifold 308 and then to the pressurized clean fluid inlet 332 of the fluid pressure exchanger 320, where the pressurized clean fluid may be utilized to pressurize the dirty fluid received at the non-pressurized dirty fluid inlet 331 from the mixer 304.

A centrifugal or other type of pump 314 may supply the clean fluid to the manifold 308 from one or more holding or frac tanks 322 through a conduit system 315. An additional source of fluid to be pressurized by the manifold 308 may be flowback fluid from the well 311. The pressurized clean fluid is conducted from the manifold 308 to one or more chambers of the fluid pressure exchanger 320 via a conduit system 316. The pressurized fluid discharged from the fluid pressure exchanger 320 is then conducted to the wellhead 313 of the well 311 via a conduit system 309. The reduced-pressure clean fluid remaining in the fluid pressure exchanger 320 (or chamber 100/150 thereof) may then be conducted to one or more settling tanks/pits 318 via a conduit system 317, where the fluid may be recycled back into the high-pressure stream via a centrifugal or other type of pump 321 and a conduit system 319, such as to the tank(s) 322.

The wellsite system 371 may further comprise pressure sensors 350 operable to generate electric signals and/or other information indicative of the pressure of the clean fluid upstream of the pressure exchanger 320 and/or the pressure of the dirty fluid discharged from the pressure exchanger 320. For example, the pressure sensors 350 may be fluidly connected along the fluid conduits 309, 316. Additional pressure sensors may also be fluidly connected along the fluid conduits 305, 317, such as may be utilized to monitor pressure of the low-pressure clean and dirty fluids.

Some of the components, such as conduits, valves, and the manifold 308, may be configured to provide dampening to accommodate pressure pulsations. For example, liners that expand and contract may be employed to prevent problems associated with pumping against a closed valve due to intermittent pumping of the high-pressure fluid stream.

Figure 13:
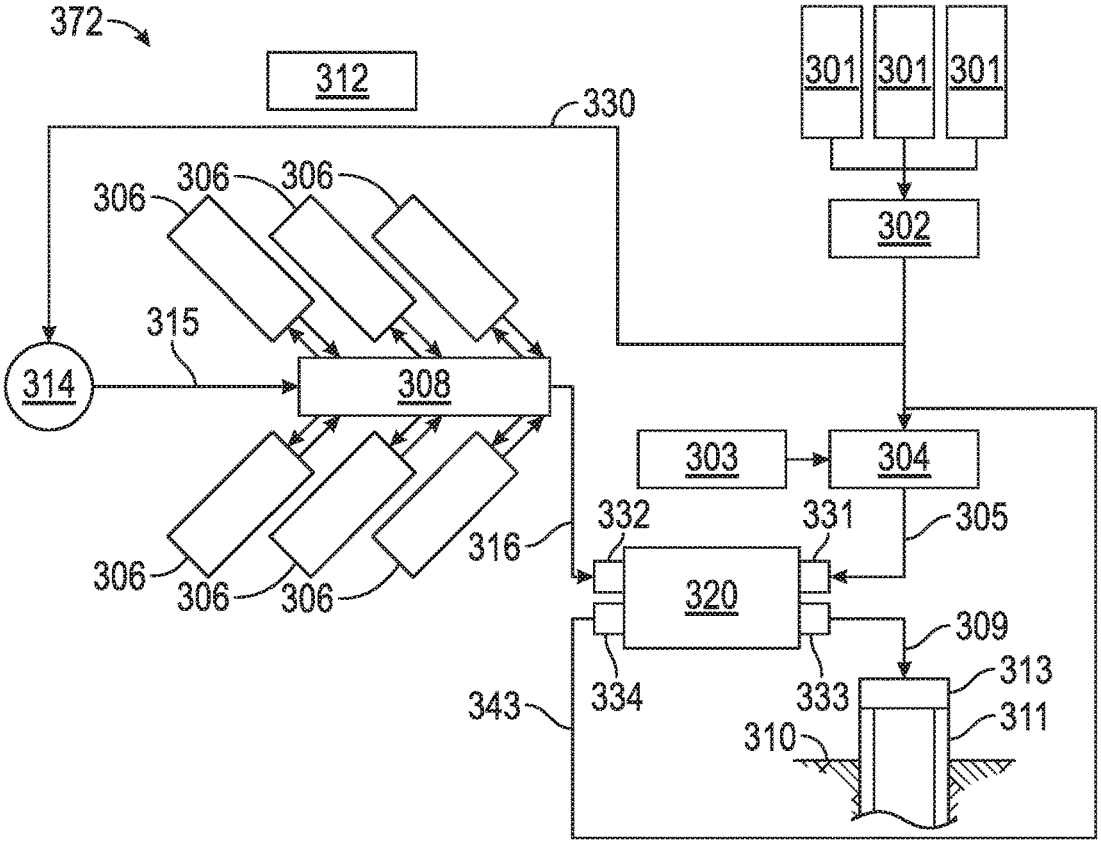
FIG. 13 is a schematic view of at least a portion of an example implementation of apparatus according to one or more aspects of the present disclosure.

FIG. 13 is a schematic view of an example implementation of another wellsite system 372 according to one or more aspects of the present disclosure. The wellsite system 372 is substantially similar in structure and operation to the wellsite system 371, including where indicated by like reference numbers, except as described below.

In the wellsite system 372, the clean fluid may be conducted to the manifold 308 via a conduit system 330, the pump 314, and the conduit system 315. That is, the fluid stream leaving the gel maker 302 may be split into a low-pressure side, for utilization by the mixer 304, and a high-pressure side, for pressurization by the manifold 308. Similarly, although not depicted in FIG. 13, the fluid stream entering the gel maker 302 may be split into the low-pressure side, for utilization by the gel maker 302, and the high-pressure side, for pressurization by the manifold 308. Thus, the clean fluid stream and the dirty fluid stream may have the same source, instead of utilizing the tank 322 or other separate clean fluid source.

FIG. 13 also depicts the option for the reduced-pressure fluid discharged from the fluid pressure exchanger 320 to be recycled back into the low-pressure clean fluid stream between the gel maker 302 and the mixer 304 via a conduit system 343. In such implementations, the flow rate of the proppant and/or other ingredients from the solids container 303 into the mixer 304 may be regulated based on the concentration of the proppant and/or other ingredients entering the low-pressure stream from the conduit system 343. The flow rate from the solids container 303 may be adjusted to decrease the concentration of proppant and/or other ingredients based on the concentrations in the fluid being recycled into the low-pressure stream. Similarly, although not depicted in FIG. 13, the reduced-pressure fluid discharged from the fluid pressure exchanger 320 may be recycled back into the low-pressure flow stream before the gel maker 302, or perhaps into the low-pressure flow stream between the mixer 304 and the fluid pressure exchanger 320.

Figure 14:
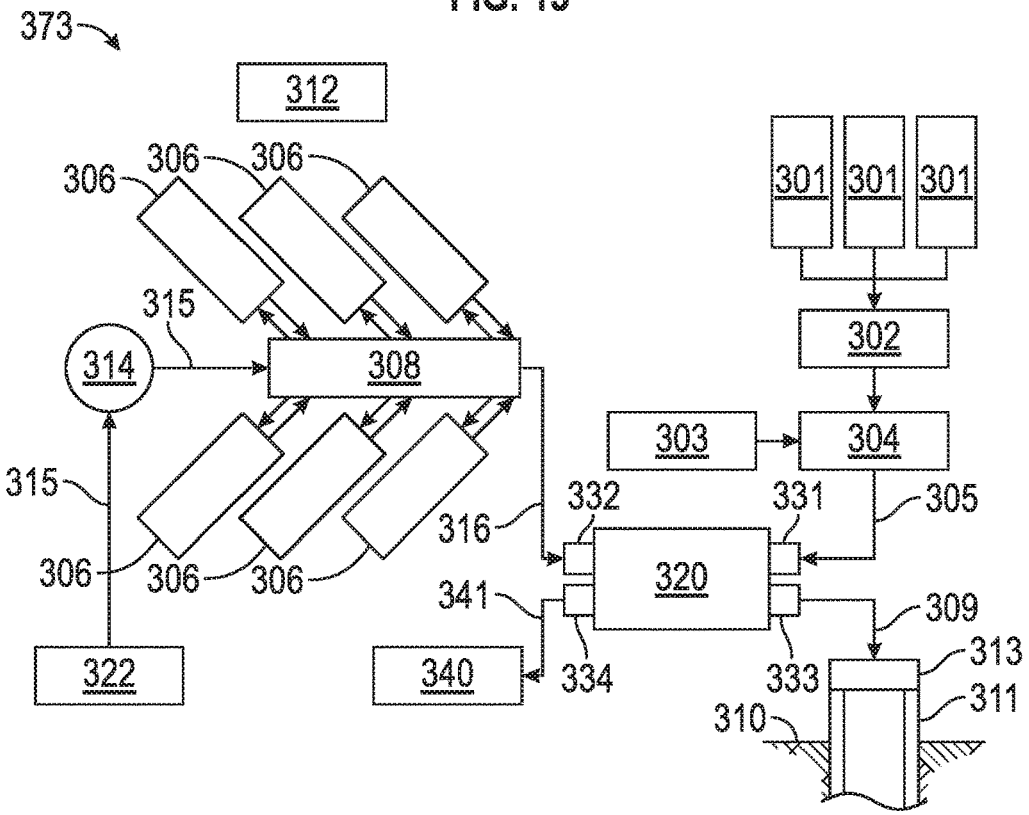
FIG. 14 is a schematic view of at least a portion of an example implementation of apparatus according to one or more aspects of the present disclosure.

FIG. 14 is a schematic view of an example implementation of another wellsite system 373 according to one or more aspects of the present disclosure. The wellsite system 373 is substantially similar in structure and operation to the wellsite system 372, including where indicated by like reference numbers, except as described below.

In the wellsite system 373, the source of the clean fluid is the tank 322, and the reduced-pressure fluid discharged from the fluid pressure exchanger 320 is not recycled back into the high-pressure stream, but is instead directed to a tank 340 via a conduit system 341. However, in similar implementations, the reduced-pressure fluid discharged from the fluid pressure exchanger 320 may not be recycled back into the high-pressure stream, as depicted in FIG. 13. In either case, utilizing the tank 322 or other source of the clean fluid separate from the discharge of the gel maker 302 and the fluid pressure exchanger 320 may permit a single-pass clean fluid system with very low probability of proppant entering the pumps 306.

Figure 15:
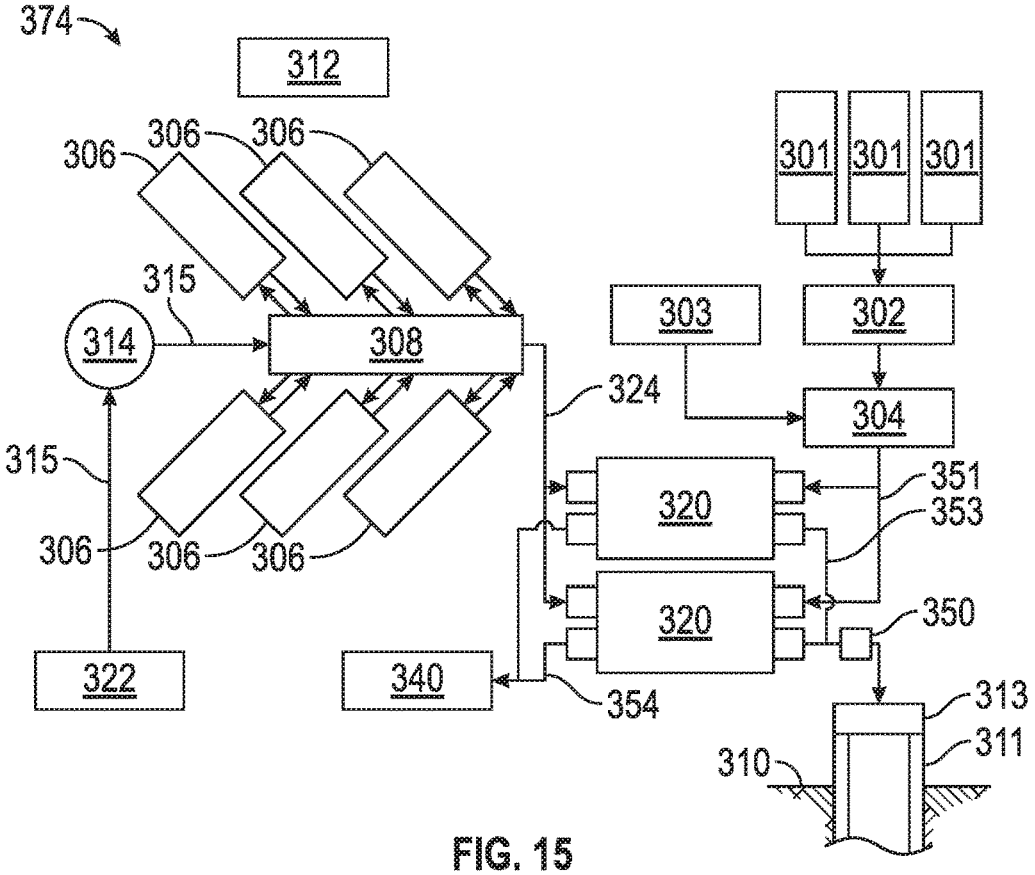
FIG. 15 is a schematic view of at least a portion of an example implementation of apparatus according to one or more aspects of the present disclosure.

FIG. 15 is a schematic view of an example implementation of another wellsite system 374 according to one or more aspects of the present disclosure. The wellsite system 374 is substantially similar in structure and operation to the wellsite system 373, including where indicated by like reference numbers, except as described below.

Unlike the wellsite system 373, the wellsite system 374 utilizes multiple instances of the fluid pressure exchanger 320. The low-pressure discharge from the mixer 304 may be split into multiple streams each conducted to a corresponding one of the fluid pressure exchangers 320 via a conduit system 351. Similarly, the high-pressure discharge from the manifold 308 may be split into multiple streams each conducted to a corresponding one of the fluid pressure exchangers 320 via a conduit system 352. The pressurized fluid discharged from the fluid pressure exchangers 320 may be combined and conducted towards the well 311 via a conduit system 353, and the reduced-pressure discharge from the fluid pressure exchangers 320 may be combined or separately conducted to the tank 340 via a conduit system 354.

Figure 16:
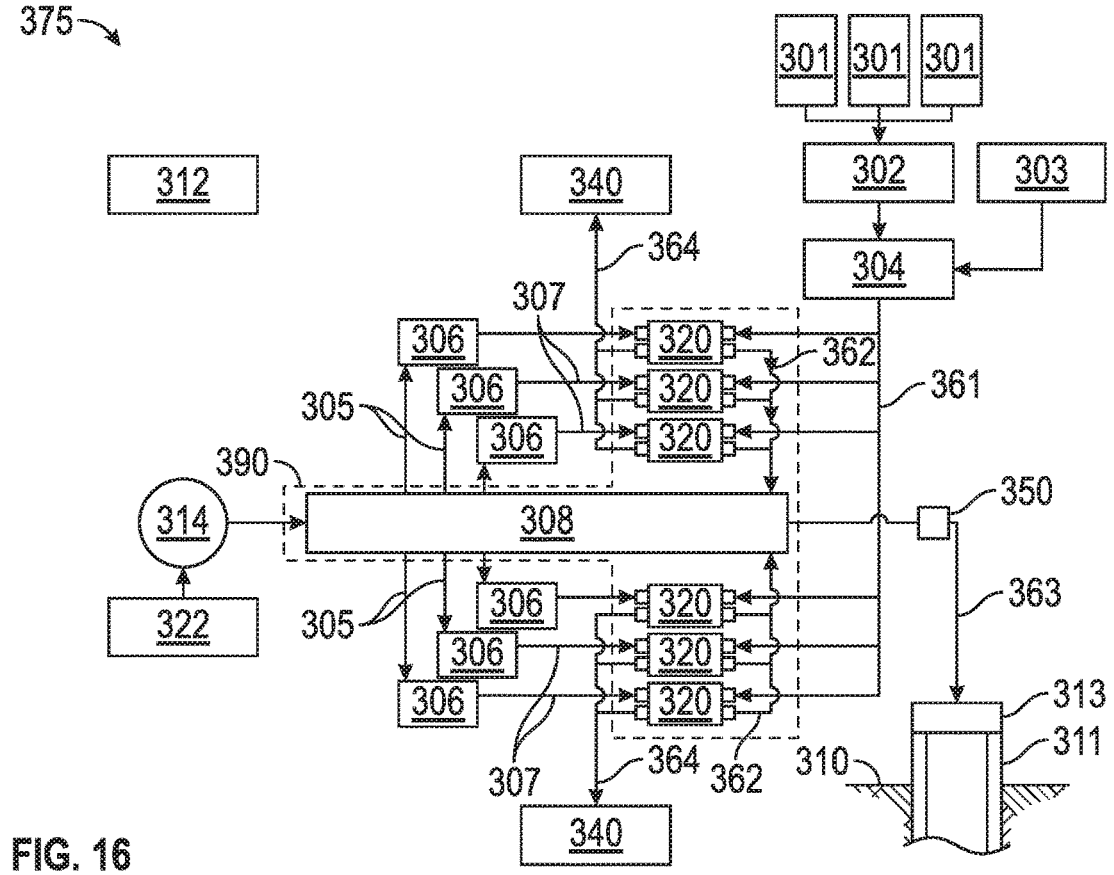
FIG. 16 is a schematic view of at least a portion of an example implementation of apparatus according to one or more aspects of the present disclosure.

FIG. 16 is a schematic view of an example implementation of another wellsite system 375 according to one or more aspects of the present disclosure. The wellsite system 375 is substantially similar in structure and operation to the wellsite system 373, including where indicated by like reference numbers, except as described below.

Unlike the wellsite system 373, the wellsite system 375 includes multiple instances of the fluid pressure exchanger 320 between the manifold 308 and a corresponding one of the pumps 306. The low-pressure discharge from the mixer 304 may be split into multiple streams each conducted to a corresponding one of the fluid pressure exchangers 320 via a corresponding conduit of a conduit system 361. The high-pressure discharge from each of the pumps 306 may be conducted to a corresponding one of the fluid pressure exchangers 320 via corresponding conduits 307. The pressurized fluid discharged from each fluid pressure exchanger 320 is returned to the manifold 308 for combination, via a conduit system 362, and then conducted towards the well 311 via a conduit system 363. The reduced-pressure discharge from the fluid pressure exchangers 320 may be combined or separately conducted to one or more tanks 340 via a conduit system 364.

One or more of the pressure exchangers 320 may be integrated or otherwise combined with the manifold 308 as a single unit or piece of wellsite equipment. For example, one or more of the pressure exchangers 320 and the manifold 308 may be combined to form a manifold 390 comprising fluid pathways and connections of the manifold 308 and one or more of the pressure exchangers 320 hard-piped or otherwise integrated with or along such fluid pathways and connections. Accordingly, the mixer 304 and each pump 306 may be fluidly connected with corresponding inlet ports of the manifold 390 instead of with individual inlet ports 331, 332 of the pressure exchangers 320. For example, the manifold 390 may comprise a plurality of clean fluid inlet ports each fluidly connected with a corresponding fluid conduit 307 to receive the clean fluid from the pumps 306. Each clean fluid inlet port may in turn be fluidly connected with the clean fluid inlet 332 of a corresponding pressure exchanger 320. The manifold 390 may further comprise a plurality of dirty fluid inlet ports, each fluidly connected with a corresponding fluid conduit of the conduit system 361 and operable to receive the dirty fluid from the mixer 304. Each dirty fluid inlet port may in turn be fluidly connected with the dirty fluid inlet 331 of a corresponding pressure exchanger 320. The manifold 390 may also comprise a plurality of clean fluid outlet ports, each fluidly connected with a corresponding fluid conduit of the conduit system 364 and operable to discharge the clean fluid from the manifold 390. Each clean fluid outlet port may in turn be fluidly connected with the clean fluid outlet 334 of a corresponding pressure exchanger 320. The manifold 390 may also comprise a dirty fluid outlet port fluidly connected with the conduit system 363 and operable to discharge the dirty fluid from the manifold 390. The dirty fluid outlet port may in turn be fluidly connected with the dirty fluid outlets 333 of the pressure exchangers 320.

The wellsite system 371 may further comprise a plurality of pressure sensors 350, each operable to generate an electric signal and/or other information indicative of pressure of the clean fluid being injected into the pressure exchanger 320 and/or pressure of the dirty fluid discharged from the pressure exchanger 320. For example, a pressure sensor 350 may be fluidly connected along each of the fluid conduits 307 or otherwise at each of the fluid inlets 332 of the pressure exchangers 320 to monitor pressure of the clean fluid being injected into each pressure exchanger 320. A pressure sensor 350 may also be fluidly connected along each of the fluid conduits 363 or otherwise at each of the fluid outlets 333 of the pressure exchangers 320 to monitor pressure of the dirty fluid being discharged from each pressure exchanger 320. A pressure sensor 350 may also or instead be fluidly connected along the common fluid conduit 363 to measure pressure of the combined dirty fluid being injected into the well 311. A pressure sensor 350 may also be implemented as part of a downhole tool (not shown), which may be conveyed or installed within the well 311.

Combinations of various aspects of the example implementations depicted in FIGS. 12-16 are also within the scope of the present disclosure. For example, the high-pressure side may comprise a dual-stage pumping scheme that pumps a clean fluid from the pumps 306 at a medium pressure and pumps flowback fluid into the clean fluid stream to increase the pressure of the pressurized fluid entering the fluid pressure exchanger 320.

A wellsite system within the scope of the present disclosure may be utilized to form a substantially continuous stream or supply of dirty fluid having a predetermined solids concentration before being pressurized by one or more pressure exchangers and injected into a well during a well treatment operation. For example, the solids concentration of the dirty fluid stream being formed and injected into the well may be held substantially constant during the well treatment operation. However, the solids concentration of the dirty fluid may be dynamically varied during the well treatment operation.

The present disclosure is further directed to a wellsite system, such as the wellsite system 375, operable to control or otherwise utilize pressure oscillations (e.g., pressure fluctuations or variations) formed within a dirty fluid being pressurized and discharged from a plurality of rotary pressure exchangers and injected into a wellbore. Frequency and phase of the pressure oscillations formed within the dirty fluid by each pressure exchanger may be controlled (e.g., modulated, adjusted) to control amplitude and/or frequency of resulting (i.e., combined) pressure oscillations formed within the dirty fluid combined from the individual pressure exchangers and injected into the wellbore. For example, the pressure exchangers may be operated as an acoustic source, such as may be utilized for communication between a wellsite surface and a downhole tool (e.g., via mud pulse telemetry) or for performing wellbore scans (e.g., via tube waves). The pressure exchangers may also or instead be operated in a manner, such as to minimize amplitude of pressure oscillations within the dirty fluid being injected into the wellbore to reduce damage to downstream equipment caused by extended exposure to excessive pressure oscillations.

Figure 17:
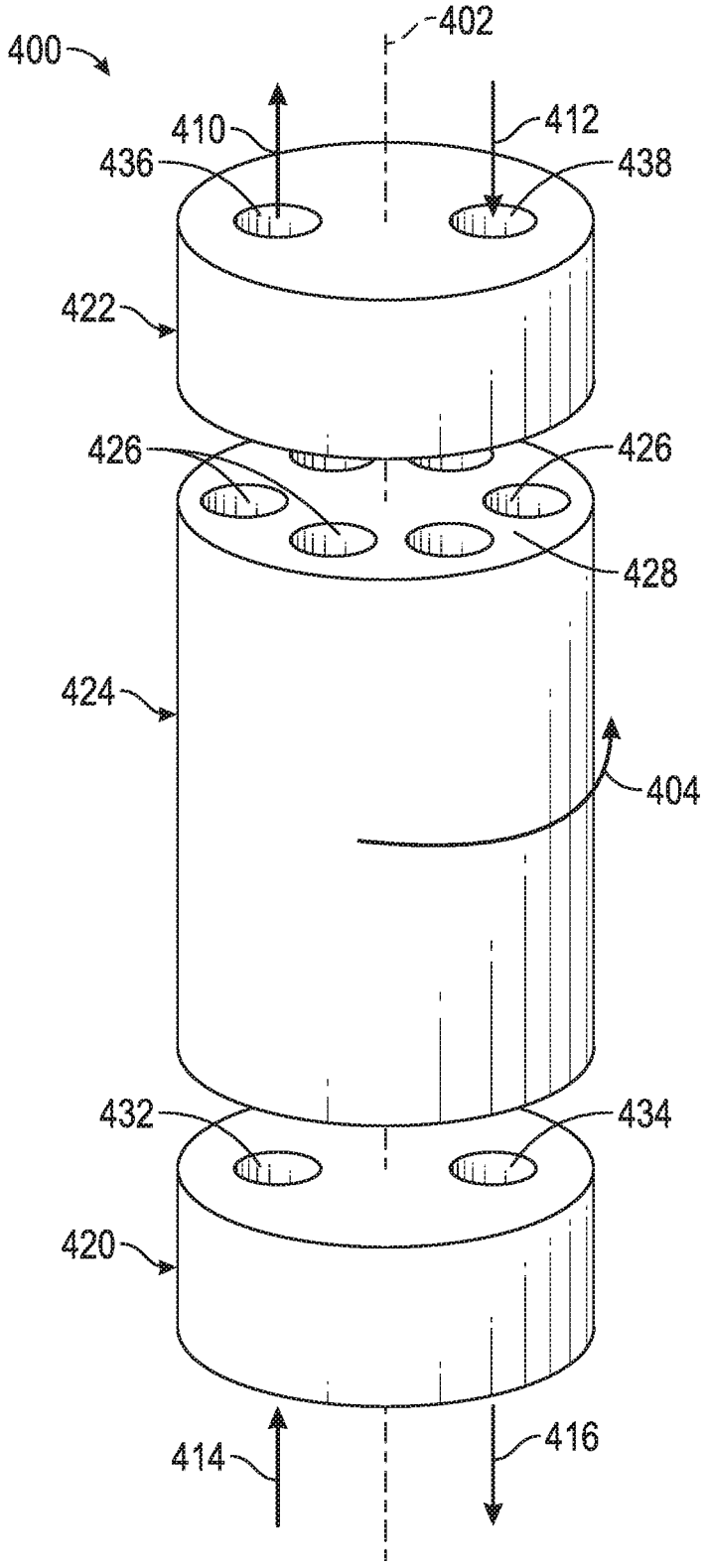
FIG. 17 is an exploded view of at least a portion of an example implementation of apparatus according to one or more aspects of the present disclosure.

FIG. 17 is an exploded schematic view of an example implementation of a rotary pressure exchanger 400 according to one or more aspects of the present disclosure. The pressure exchanger 400 comprises one or more features of the pressure exchangers 200, 270, 320 described above, except as described below. The pressure exchanger 400 may be interchangeable with the pressure exchangers 200, 270, 320, such that one or more of the pressure exchangers 400 may be utilized as part of the wellsite systems 371-375 shown in FIGS. 12-16 instead of or in conjunction with one or more of the pressure exchangers 200, 270, 320. Accordingly, one or more aspects of the following description may also refer to one or more of FIGS. 1-16.

The pressure exchanger 400 comprises a rotating rotor 424 (i.e., core) containing a plurality of fluid chambers 426 (i.e., axial flow passages) extending therethrough between opposing faces 428 (i.e., ends) of the rotor 424. The chambers 426 may be circumferentially spaced or otherwise distributed around the central axis 402 of the rotor 424. The rotor 424 may be a discrete member, as depicted in FIG. 17, or an assembly of discrete components, such as may permit replacing worn portions of the rotor 424 and/or utilizing different materials for different portions of the rotor 424 to account for expected or actual wear. The pressure exchanger 400 may further comprise opposing end caps 420, 422 disposed against the opposing faces 428 of the rotor 424 in a manner permitting relative rotation of the rotor 424 with respect to the end caps 420, 422 along the central axis 402 (i.e., axis of rotation), as indicated by arrow 404.

The end cap 420 may contain a high-pressure fluid inlet 432 operable to receive a stream of high-pressure clean fluid, as indicated by arrow 414, and a low-pressure fluid outlet 434 operable to discharge a stream of low-pressure (i.e., depressurized) clean fluid, as indicated by arrow 416. The end cap 422 may contain a high-pressure fluid outlet 436 operable to discharge a stream of high-pressure (i.e., pressurized) dirty fluid, as indicated by arrow 410, and a low-pressure fluid inlet 438 operable to receive a stream of low-pressure dirty fluid, as indicated by arrow 412. The high-pressure inlet 432 may be fluidly connected with a source of pressurized clean fluid, such as the pumps 306. The low-pressure outlet 434 may be fluidly connected with a destination of depressurized clean fluid, such as the settling tank/pit 318, 340 or the suction port of the mixer 304. The low-pressure inlet 438 may be fluidly connected with a source of low-pressure dirty fluid, such as the discharge port of the mixer 304. The high-pressure outlet 436 may be fluidly connected with a destination of the pressurized dirty fluid, such as the well 311. The pressure exchanger 400 may further comprise a housing (not shown) that is similar to the housing 210 shown in FIGS. 5-7. As described above with respect to FIGS. 5-7, the housing 210 may contain the rotor 424 slidably disposed therein and may sealingly engage the end caps 420, 422.

During fluid pressurizing operations, as the rotor 424 rotates with respect to the housing 210 and the end caps 420, 422, the low-pressure dirty fluid enters one or more of the chambers 426 aligned or fluidly connected with the inlet 438 via the inlet 438, as indicated by arrow 412, and pushes the low-pressure clean fluid out of those chambers 426 via the low-pressure outlet port 434, as indicated by arrow 416. Simultaneously, the pressurized clean fluid enters another one or more of the chambers 426 aligned or fluidly connected with the inlet port 432 via the inlet port 432, as indicated by arrow 414, and pushes the low-pressure dirty fluid out of those chambers 426 via the high-pressure outlet port 436, to pressurize and discharge the dirty fluid.

Figure 18:
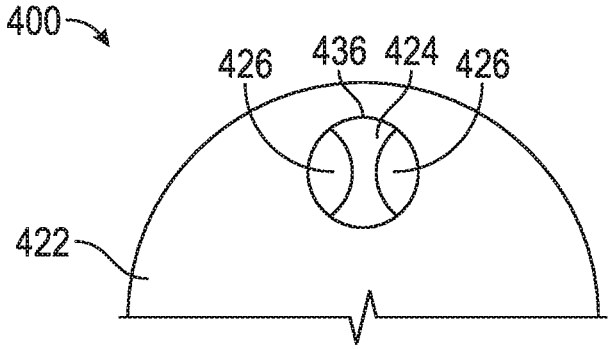
FIG. 18 is a top view of a portion of the apparatus shown in FIG. 17 according to one or more aspects of the present disclosure.
Figure 19:
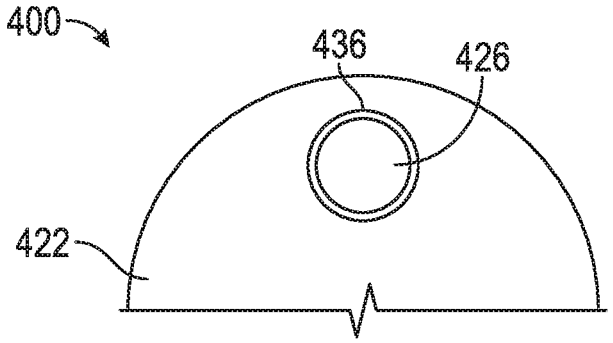
FIG. 19 is a view of the apparatus shown in FIG. 18 at different stage of operations according to one or more aspects of the present disclosure.

FIGS. 18 and 19 are top views of a portion of the pressure exchanger 400 shown in FIG. 17 during different stages of pressurizing (i.e., pumping) operations according to one or more aspects of the present disclosure. FIG. 18 shows the pressure exchanger 400 when two adjacent chambers 426 are partially aligned with the outlet 436, resulting in the body of the rotor 424 partially blocking or obstructing the outlet 436. At the same time, the body of the rotor 424 may similarly partially block or obstruct the inlet 432. Accordingly, the body of the rotor 424 may partially block or obstruct the fluid flow between the inlet 432 and the outlet 436, causing a substantial pressure drop across the rotor 424 between the inlet 342 and the outlet 436. FIG. 19 shows the pressure exchanger 400 when one of the chambers 426 is fully aligned with the outlet 436, resulting in free and unobstructed fluid flow out of the outlet 436. At the same time, the chamber 462 may also be fully aligned with the inlet 432. Accordingly, when one or more of the chambers 426 of the rotor 424 are fully aligned with the inlet 432 and the outlet 436, the rotor 424 permits substantially free and unobstructed fluid flow between the inlet 342 and the outlet 436, resulting in a substantially lower pressure drop across the rotor 424 between the inlet 342 and the outlet 436 compared to pressure drop when the body of the rotor 424 partially blocks or obstructs the fluid flow between the inlet 432 and the outlet 436.

Figure 20:
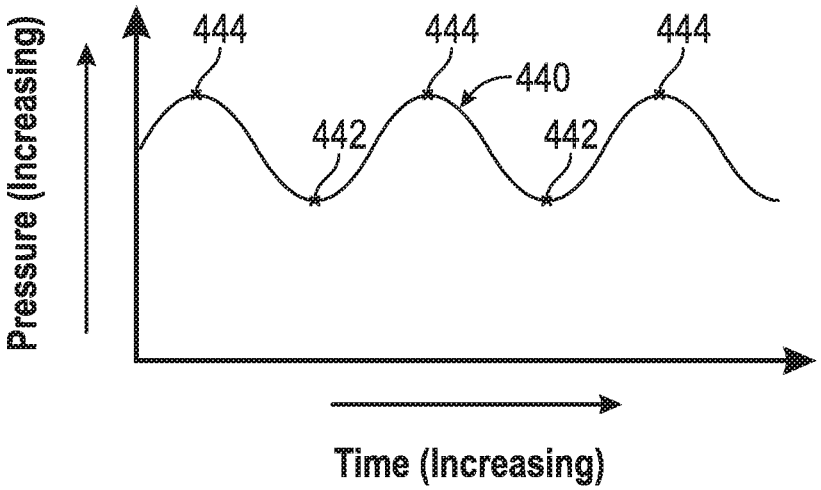
FIGS. 20-33 are graphs related to one or more aspects of the present disclosure.

FIG. 20 is a graph showing an example pressure profile 440 of the pressurized dirty fluid discharged from the pressure exchanger 400 via the outlet 436 according to one or more aspects of the present disclosure. The horizontal axis indicates time and the vertical axis indicates pressure. The pressure profile 440 depicts a simplified view of pressure oscillations (e.g., variations) caused by changes in the flow resistance caused by the rotating rotor 424 during pressurising operations. The pressure profile 440 may be a generally sineusoidal or otherwise oscillating pressure curve comprising a plurality of dips 442, representing instances of lower pressure (i.e., higher pressure drop) caused by higher flow resistance corresponding to the pressure exchanger position shown in FIG. 18. The pressure profile 440 may further comprise a plurality of peaks 444, representing instances of higher pressure (i.e., lower pressure drop) caused by lower flow resistance corresponding to the pressure exchanger position shown in FIG. 19. The pressure oscillations may be determined or monitored by the pressure sensor 350 fluidly connected at or near the outlet 436 of the pressure exchanger 400. When multiple pressure exchangers 400 are utilized, such as part of the wellsite systems 374, 375, each outlet 436 may have an associated pressure sensor, such as the pressure sensor 350 shown in FIG. 16. The pressure of the clean fluid injected into the pressure exchanger 400 via the inlet 432 may also be monitored at or near the inlet 432. The pressure measurements captured at both the inlet 432 and the outlet 436 may be utilized to determine pressure losses across the pressure exchanger 400.

An example pressure exchanger may comprise ten chambers, thus having ten cycles per revolution. Operating (i.e., rotation) speeds of the rotor may range between about 300 revolutions per minute (RPM) and about 1500 RPM or more. Such speeds correspond to operating (i.e., fluid passing) frequencies ranging between about 50 Hertz (Hz) and about 250 Hz. There may exist restrictions on operating speeds of the rotor. For example, an operating speed that is too low may permit the dirty-clean fluid interface to move too close to the end of the chambers, while an operating speed that is too high may cause excessive compression and decompression losses.

Figure 21:
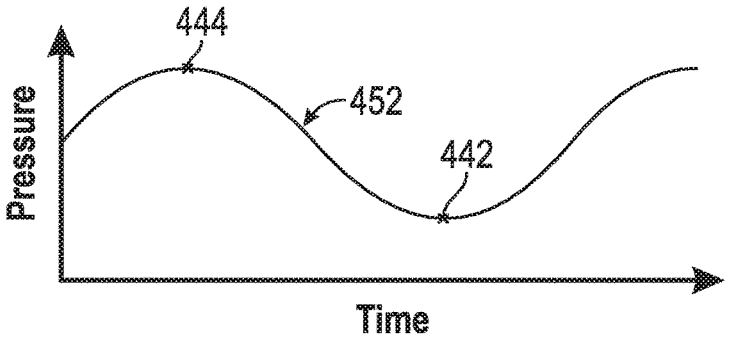
Figure 22:
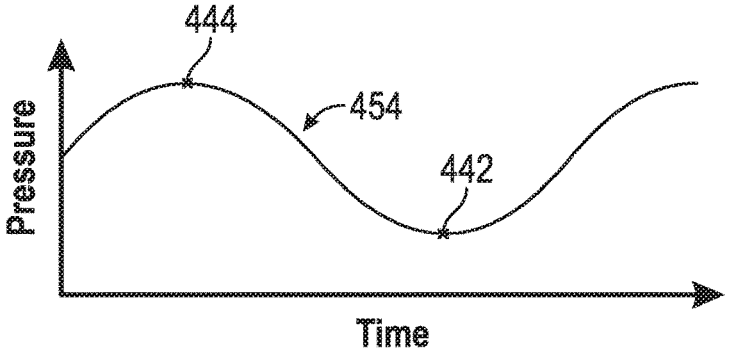
Figure 23:
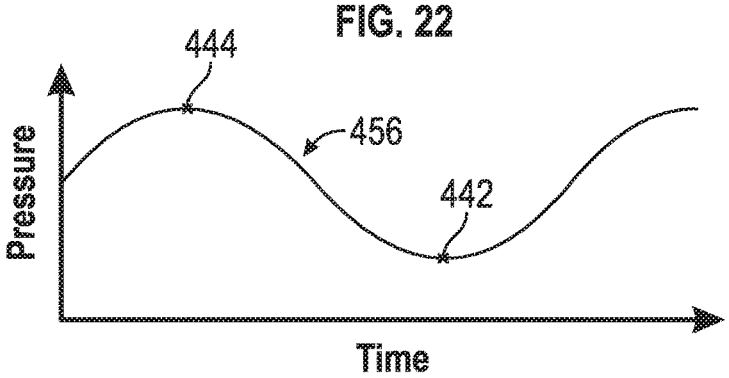

FIGS. 21-23 are graphs showing example pressure profiles 452, 454, 456 of the streams of pressurized dirty fluid discharged via the outlets 436 of the corresponding pressure exchangers 400 according to one or more aspects of the present disclosure. The horizontal axes indicate time and the vertical axes indicate pressure. The pressure profiles 452, 454, 456 depict simplified views of the pressure oscillations at or near the outlets 436 of the corresponding pressure exchangers 400. The rotors 424 of the pressure exchangers 400 associated with the pressure profiles 452, 454, 456 are operated in phase, resulting in the pressure oscillations of the pressure profiles 452, 454, 456 also occurring in phase, whereby the peaks 444 and dips 442 occur at the same time.

Figure 24:
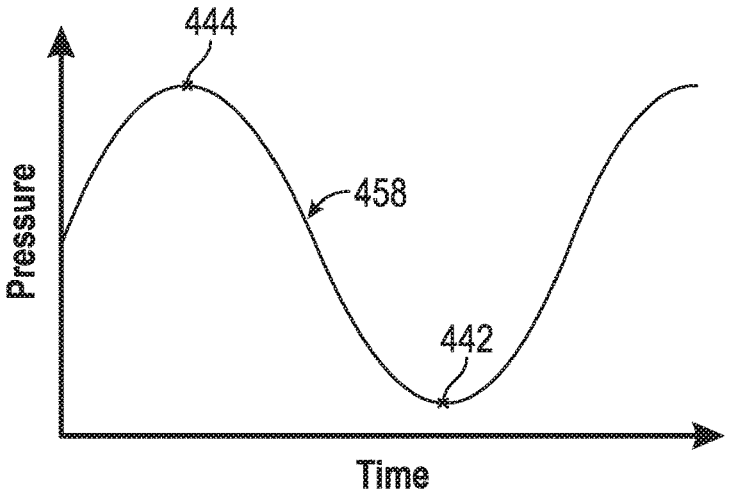

The outlets 436 of the pressure exchangers 400 forming the pressure profiles 452, 454, 456 are fluidly connected to combine the individual streams of pressurized dirty fluid into a common fluid conduit, such as the common fluid conduit 362 shown in FIG. 16, to form a combined stream of dirty fluid for injection into the well 311. As the individual streams of pressurized dirty fluid are combined into the combined stream of dirty fluid, the pressure oscillations within the individual streams of pressurized dirty fluid are also combined (i.e., summed) to form combined pressure oscillations within the combined pressurized stream of dirty fluid. FIG. 24 is a graph showing a combined (i.e., cumulative) pressure profile 458 of the combined pressurized stream of dirty fluid flowing through the common fluid conduit 363 fluidly connected with the individual outlets 436 of the pressure exchangers 400 associated with the pressure profiles 452, 454, 456 according to one or more aspects of the present disclosure. The individual outlets 436 of the pressure exchangers 400 may be fluidly connected with the common fluid conduit 362 via the manifold 390 or conduit system 362 shown in FIG. 16. The pressure profiles 452, 454, 456 are summed additively, resulting in the combined pressure profile 458. As described above, the rotors 424 of the pressure exchangers 400 associated with the pressure profiles 452, 454, 456 are phased or otherwise operating in phase, resulting in combined pressure oscillations within the combined pressurized stream of dirty fluid comprising greater pressure variations (e.g., pressure amplitudes) between the peaks 444 and the dips 442.

Figure 25:
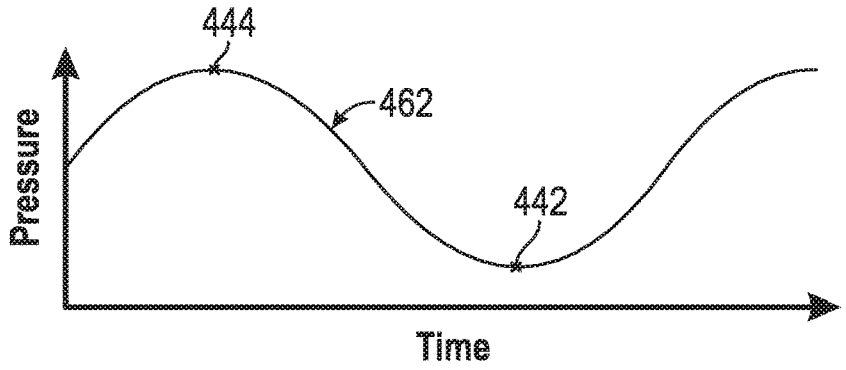
Figure 26:
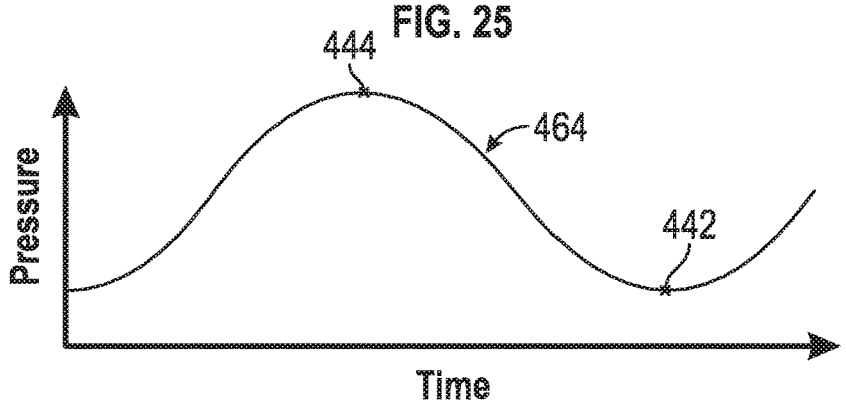
Figure 27:
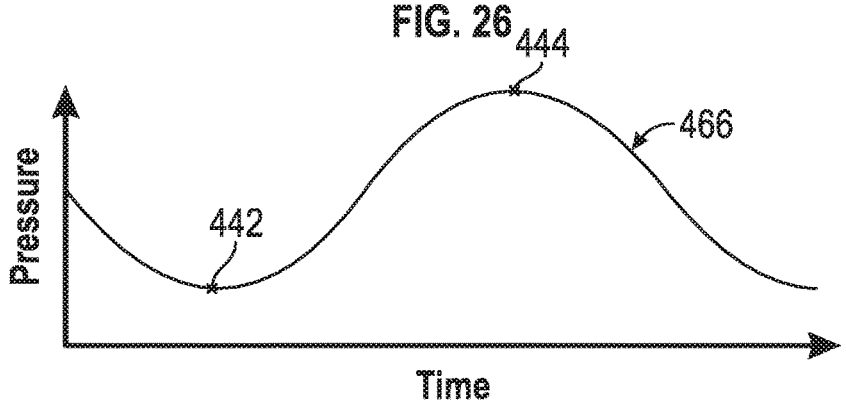

FIGS. 25-27 are graphs showing example pressure profiles 462, 464, 466 of the pressurized dirty fluid discharged via the outlets 436 of the corresponding pressure exchangers 400 according to one or more aspects of the present disclosure. The horizontal axes indicate time and the vertical axes indicate pressure. The pressure profiles 462, 464, 466 depict simplified views of the pressure oscillations at or near the outlets 436 of the corresponding pressure exchangers 400. However, unlike the pressure exchangers 400 associated with the pressure profiles 452, 454, 456, the rotors 424 of the pressure exchangers 400 associated with the pressure profiles 462, 464, 466 are operated at least partially out of phase, resulting in the pressure oscillations of the pressure profiles 462, 464, 466 also occurring at least partially out of phase, whereby the peaks 444 and dips 442 occur at different times. The pressure oscillations of the pressure profiles 462, 464, 466 are shown out of phase by about 120 degrees, however the rotors 424 may be operated such that the pressure profiles 462, 464, 466 are out of phase by a different rotational distance or angle.

Figure 28:
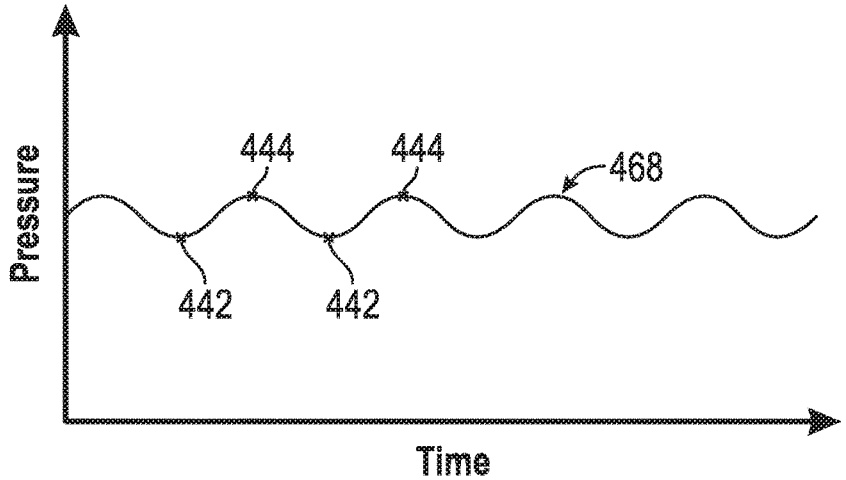

The outlets 436 of the pressure exchangers 400 forming the pressure profiles 462, 464, 466 are also fluidly connected to combine the individual streams of pressurized dirty fluid into a common fluid conduit, such as the common fluid conduit 362, to form a combined stream of dirty fluid for injection into the well 311. As the individual streams of pressurized dirty fluid are combined into the combined stream of dirty fluid, the pressure oscillations within the individual streams of pressurized dirty fluid are also combined to form combined pressure oscillations within the combined pressurized stream of dirty fluid. FIG. 28 is a graph showing a combined pressure profile 468 of the combined pressurized stream of dirty fluid flowing through the common fluid conduit 363 fluidly connected with the individual outlets 436 of the pressure exchangers 400 associated with the pressure profiles 462, 464, 466 according to one or more aspects of the present disclosure. The individual outlets 436 of the pressure exchangers 400 may be fluidly connected with the common fluid conduit 362 via the manifold 390 or conduit system 362. The pressure profiles 462, 464, 466 are summed additively, resulting in the combined pressure profile 468. As described above, the rotors 424 of the pressure exchangers 400 associated with the pressure profiles 462, 464, 466 are operated out of phase or are otherwise phased to produce a reduced (e.g., minimum) sum, resulting in pressure oscillations comprising smaller pressure variations between the peaks 444 and the dips 442. In other words, the out of phase pressure oscillations of the individual pressurized streams of dirty fluid partially cancel each other out when combined within the combined pressurized stream of dirty fluid passed along the common fluid conduit 363. Decreasing amplitudes of pressure oscillations may decrease pressure related damage to fluid conduits or equipment downstream of the pressure exchangers caused by prolonged exposure to excessive pressure oscillations.

Similar low variations can be produced with multiple pressure exchangers 400 operating at rotating speeds (i.e., frequencies) that vary over time, such that the likelihood of synchronization (i.e., in phase operation) is reduced or minimized. Furthermore, each pressure exchanger 400 may be operated at a different speed to reduce or minimize the likelihood of synchronization. Also, rotor rotation speed variation may avoid potentially exciting a specific resonance frequency within the combined pressurized stream of dirty fluid. Random rotor rotation speed variation may be effective in avoiding synchronization and/or resonance frequencies. Other means and/or methods for reducing or minimizing variations of pressure oscillations may also be utilized, including application and/or adaption of conventional or future-developed means and/or methods for reducing or minimizing pressure oscillations originating from fracturing pump arrays and/or fracturing spreads. Furthermore, operation of the pressure exchangers 400 may also be related to or dependent on operating speeds (i.e., frequencies) of pump strokes of the pumps 306 (shown in FIGS. 11-16) to enhance, modify, or minimize variations (e.g., amplitudes) of the pressure oscillations.

Figure 29:
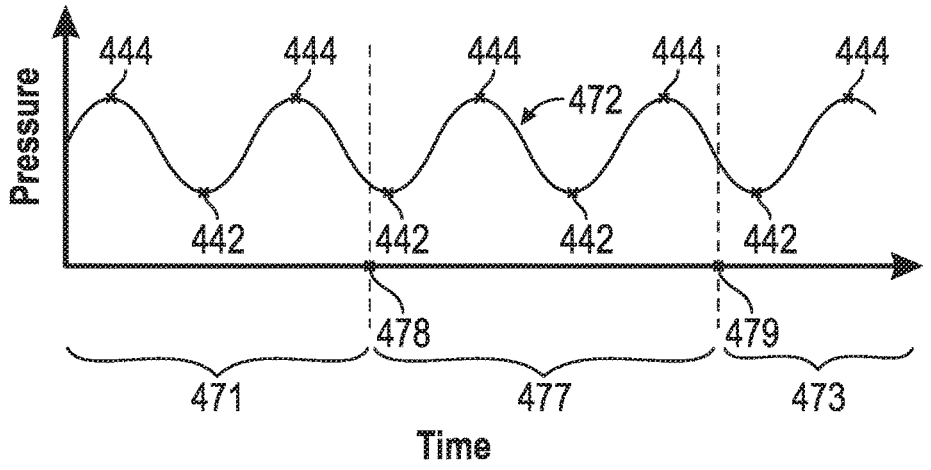
Figure 30:
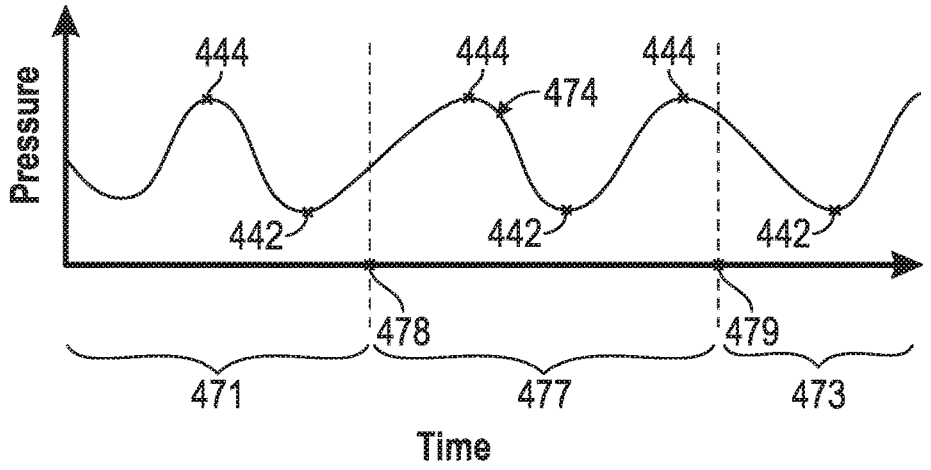

FIGS. 29 and 30 are graphs showing example pressure profiles 472, 474 of the pressurized dirty fluid discharged via the outlets 436 of corresponding pressure exchangers 400 according to one or more aspects of the present disclosure. The horizontal axes indicate time and the vertical axes indicate pressure. The pressure profiles 472, 474 depict simplified views of pressure oscillations at or near the outlets 436 of the corresponding pressure exchangers 400. The rotors 424 of the pressure exchangers 400 associated with the pressure profiles 472, 474 are operated in phase for a time period 477 ranging between time 478 and time 479 and at least partially out of phase for a period of time 471 before time 478 and for a period of time 473 after time 479. As shown in FIGS. 29 and 30, the peaks 444 and dips 442 of the pressure profiles 472, 474 within the time period 477 occur at the same time while the peaks 444 and dips 442 of the pressure profiles 472, 474 within the time periods 471, 473 occur at different times.

Figure 31:
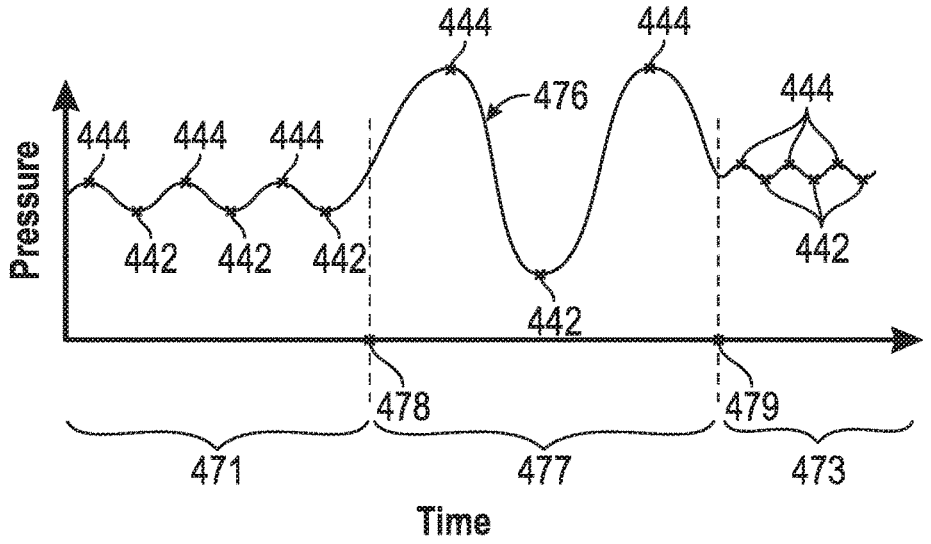

The outlets 436 of the pressure exchangers 400 forming the pressure profiles 472, 474 are also fluidly connected to combine the individual streams of pressurized dirty fluid into a common fluid conduit, such as the common fluid conduit 363, to form a combined stream of dirty fluid. As the individual streams of pressurized dirty fluid are combined into the combined stream of dirty fluid, the pressure oscillations within the individual streams of pressurized dirty fluid are also combined to form combined pressure oscillations within the combined stream of dirty fluid. FIG. 31 is a graph showing a combined pressure profile 476 of the combined pressurized stream of dirty fluid flowing through the common fluid conduit 363 fluidly connected with the outlets 436 of the pressure exchangers 400 associated with the pressure profiles 472, 474 according to one or more aspects of the present disclosure. The pressure profiles 472, 474 are summed additively, resulting in the combined pressure profile 476.

Prior to time 478, the rotors 424 of the pressure exchangers 400 associated with the pressure profiles 472, 474 are operated at a predetermined speed (i.e., frequency) such that the pressure oscillations are out of phase with respect to each other resulting in the combined pressure profile 476 having pressure variations between the peaks 444 and dips 442 that are substantially smaller than the pressure variations of the pressure profiles 472, 474. At about time 478, the rotor 424 of the pressure exchanger 400 associated with the pressure profile 474 changes speed for a period of time and, thus, changes rotational position (i.e., phase) with respect to the rotor 424 of the pressure exchanger 400 associated with the pressure profile 472, causing the pressure oscillations to also undergo a phase shift (i.e., alteration) such that both rotors 424 and, thus, the pressure oscillations of the pressure profiles 472, 474 are in phase. Such phase shift may result in the pressure profile 476 after time 478 having pressure variations between the peaks 444 and dips 442 that are substantially greater than the pressure variations of the pressure profiles 472, 474. At about time 479, the rotor 424 of the pressure exchanger 400 associated with the pressure profile 474 again changes speed for a period of time, causing the rotor 424 and, thus, pressure oscillations to undergo a phase shift such that the pressure oscillations of the pressure profiles 472, 474 are again out of phase. Such phase shift may result in the pressure profile 476 after time 479 having pressure variations between the peaks 444 and dips 442 that are substantially smaller than the pressure variations of the pressure profiles 472, 474.

Although the current disclosure associated with FIGS. 21-31 describes systems and methods of forming and controlling the amplitudes of the combined pressure oscillations within the combined streams of dirty fluid, such systems and methods may also be utilized to control frequencies of the combined pressure oscillations within combined streams of dirty fluid.

Figure 32:
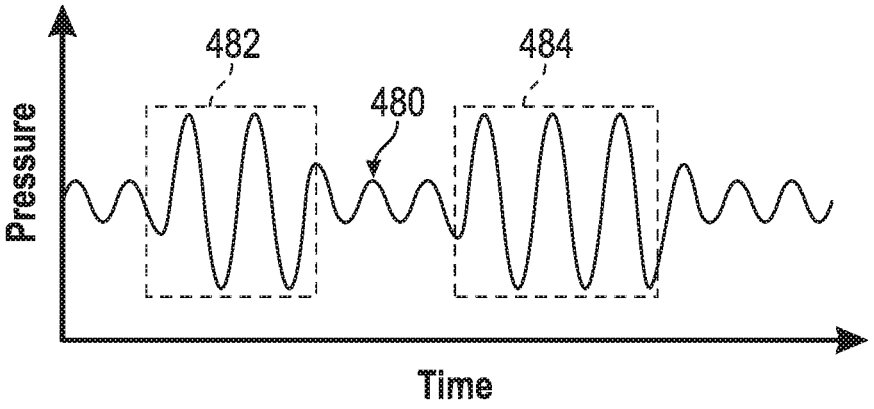

FIG. 32 is a graph showing an example combined pressure profile 480 of a combined stream of pressurized dirty fluid discharged via the fluidly connected outlets 436 of two or more pressure exchangers 400 according to one or more aspects of the present disclosure. The pressure profile 480 comprises a pair of signal chirps 482, 484 (i.e., pressure oscillations comprising varying amplitudes and/or frequencies), which may be similar to those utilized in seismic work. Phase modulation of the rotors 424 of the pressure exchangers 400 may be utilized to produce such pressure amplitude and/or frequency variation patterns.

Figure 33:
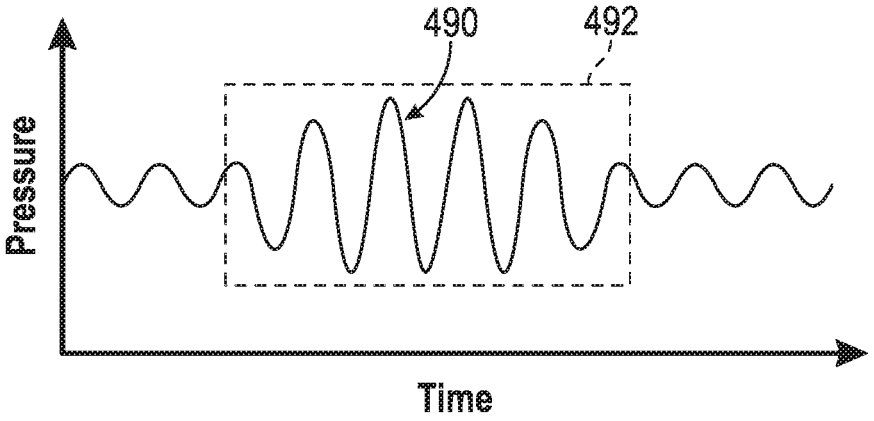

FIG. 33 is a graph showing an example combined pressure profile 490 of a combined stream of pressurized dirty fluid discharged via the fluidly connected outlets 436 of two or more pressure exchangers 400 according to one or more aspects of the present disclosure. The pressure profile 490 comprises a single signal chirp 492 having a varying frequency, such as may be formed by varying operating speeds of the rotors 424 of the pressure exchangers 400. Furthermore, by varying speed and relative position (i.e., phase) of the rotors 424 of the pressure exchangers 400, pressure oscillations having frequency content lower than the operating frequencies of the pressure exchangers 400 may be synthesized via amplitude modulation.

The rotors 424 of the pressure exchangers 400 may be operated by corresponding motors, such as the motors 260 shown in FIG. 6. The motors 260 may be operable to rotate the corresponding rotors 424 at intended rotational speeds in a manner described above. Rotational speed and rotational position (i.e., phase) of each motor 260 and/or rotor 424 may be monitored by a corresponding position sensor, such as the position sensor 214 shown in FIG. 6 and in a manner described above. A controller, such as the controller 510 shown in FIG. 34 and described below, may be communicatively connected with the motors 260 and the position sensors 214. The controller 510 may be operable to control operation of the motors 260 based on the signals received from the position sensors 214 and/or pressure sensors, such as the pressure sensors 350 shown in FIG. 16.

The pressure exchangers 320, 400 may be implemented as part of a wellsite system, such as the wellsite system 375 shown in FIG. 16, and utilized to transmit information to a tool (not shown) located along the common fluid conduit 363 or within the well 311 in the form of the combined pressure oscillations formed by the pressure exchangers 320, 400. For example, the pressure exchangers 320, 400 may be operated in the manner described above to transmit the information in the form of pressure oscillation variations within the combined stream of dirty fluid being transmitted along the common fluid conduit 363 and/or the well 311. The pressure oscillation variations may be formed in the manner described above and in a sequence such that the downstream tool will understand. The pressure oscillation variations may include alternating between periods of higher and lower amplitudes and/or frequencies of pressure oscillations, varying time periods of higher and lower amplitudes and/or frequencies of pressure amplitudes, transmitting chirps at predetermined time intervals or having predetermined amplitudes and/or frequencies, etc. The pressure exchangers 320, 400 may also be utilized to produce tube waves or other sonic waves for transmission downhole within the combined stream of dirty fluid, such as may be utilized to detect or otherwise investigate wellbore features and/or to enhance the fracturing operations.

Figure 34:
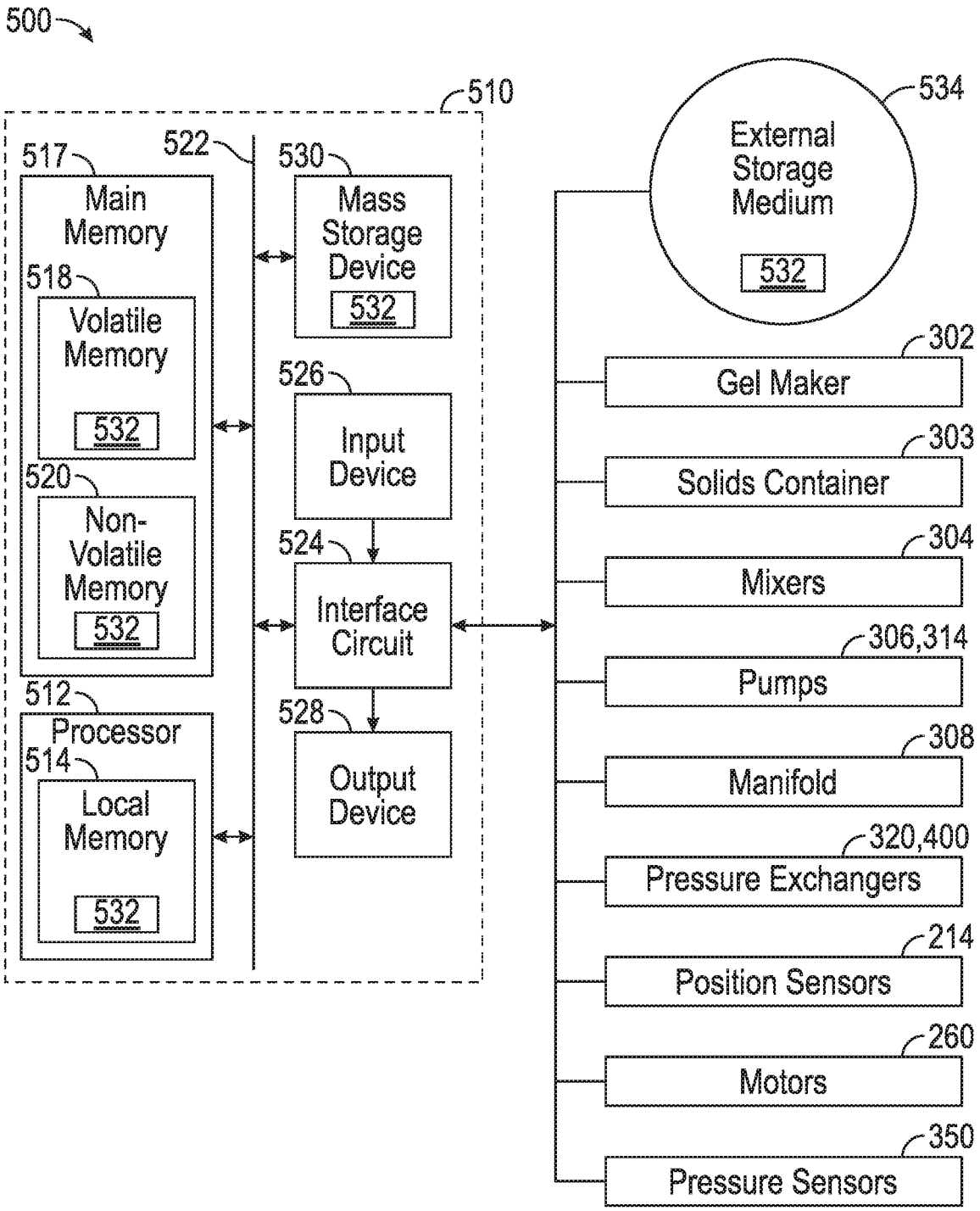
FIG. 34 is a schematic view of at least a portion of an example implementation of apparatus according to one or more aspects of the present disclosure.

Various portions of the wellsite systems 371-375 described above may collectively form and/or be controlled by a control system, such as may be operable to monitor and/or control operations of the wellsite systems 371-375. FIG. 34 is a schematic view of at least a portion of an example implementation of such a control system 500 according to one or more aspects of the present disclosure. The following description refers to one or more of FIGS. 1-34.

The control system 500 may comprise the above-mentioned controller 510, which may be in communication with the gel maker 302, the solids container 303, the mixers 304, the pumps 306, 314, the manifold 308, the pressure exchangers 320, the position sensors 214, the motors 260, the pressure sensors 350, and/or actuators associated with one or more of these components. For clarity, these and other components in communication with the controller 510 will be collectively referred to hereinafter as "controlled equipment." The controller 510 may be operable to receive coded instructions 532 from wellsite operators and signals generated by the controlled equipment, process the coded instructions 532 and the signals, and communicate control signals to the controlled equipment to execute the coded instructions 532 to implement at least a portion of one or more example methods and/or processes described herein, and/or to implement at least a portion of one or more of the example systems described herein. The controller 510 may be or form a portion of the control unit 312.

The controller 510 may be or comprise, for example, one or more processors, special-purpose computing devices, servers, personal computers (e.g., desktop, laptop, and/or tablet computers) personal digital assistant (PDA) devices, smartphones, internet appliances, and/or other types of computing devices. The controller 510 may comprise a processor 512, such as a general-purpose programmable processor. The processor 512 may comprise a local memory 514, and may execute coded instructions 532 present in the local memory 514 and/or another memory device. The processor 512 may execute, among other things, the machine-readable coded instructions 532 and/or other instructions and/or programs to implement the example methods and/or processes described herein. The programs stored in the local memory 514 may include program instructions or computer program code that, when executed by an associated processor, facilitate the wellsite system 371-375 to perform the example methods and/or processes described herein. The processor 512 may be, comprise, or be implemented by one or more processors of various types suitable to the local application environment, and may include one or more of general-purpose computers, special-purpose computers, microprocessors, digital signal processors (DSPs), field-programmable gate arrays (FPGAs), application-specific integrated circuits (ASICs), and processors based on a multi-core processor architecture, as non-limiting examples. Of course, other processors from other families are also appropriate.

The processor 512 may be in communication with a main memory 517, such as may include a volatile memory 518 and a non-volatile memory 520, perhaps via a bus 522 and/or other communication means. The volatile memory 518 may be, comprise, or be implemented by random access memory (RAM), static random access memory (SRAM), synchronous dynamic random access memory (SDRAM), dynamic random access memory (DRAM), RAMBUS dynamic random access memory (RDRAM), and/or other types of random access memory devices. The non-volatile memory 520 may be, comprise, or be implemented by read-only memory, flash memory, and/or other types of memory devices. One or more memory controllers (not shown) may control access to the volatile memory 518 and/or non-volatile memory 520.

The controller 510 may also comprise an interface circuit 524. The interface circuit 524 may be, comprise, or be implemented by various types of standard interfaces, such as an Ethernet interface, a universal serial bus (USB), a third generation input/output (3GIO) interface, a wireless interface, a cellular interface, and/or a satellite interface, among others. The interface circuit 524 may also comprise a graphics driver card. The interface circuit 524 may also comprise a communication device, such as a modem or network interface card to facilitate exchange of data with external computing devices via a network (e.g., Ethernet connection, digital subscriber line (DSL), telephone line, coaxial cable, cellular telephone system, satellite, etc.). One or more of the controlled equipment may be connected with the controller 510 via the interface circuit 524, such as may facilitate communication between the controlled equipment and the controller 510.

One or more input devices 526 may also be connected to the interface circuit 524. The input devices 526 may permit the wellsite operators to enter the coded instructions 532, including control commands, operational set-points, and/or other data for use by the processor 512. The operational set-points may include, as non-limiting examples, intended operating speeds and/or relative positions (i.e., phases) of the pressure exchangers 320 to produce intended pressure oscillations in the combined fluid conduit 363 downstream from the pressure exchangers 320. The input devices 526 may be, comprise, or be implemented by a keyboard, a mouse, a touchscreen, a track-pad, a trackball, an isopoint, and/or a voice recognition system, among other examples.

One or more output devices 528 may also be connected to the interface circuit 524. The output devices 528 may be, comprise, or be implemented by display devices (e.g., a liquid crystal display (LCD), a light-emitting diode (LED) display, or cathode ray tube (CRT) display), printers, and/or speakers, among other examples. The controller 510 may also communicate with one or more mass storage devices 530 and/or a removable storage medium 534, such as may be or include floppy disk drives, hard drive disks, compact disk (CD) drives, digital versatile disk (DVD) drives, and/or USB and/or other flash drives, among other examples.

The coded instructions 532 may be stored in the mass storage device 530, the main memory 517, the local memory 514, and/or the removable storage medium 534. Thus, the controller 510 may be implemented in accordance with hardware (perhaps implemented in one or more chips including an integrated circuit, such as an ASIC), or may be implemented as software or firmware for execution by the processor 512. In the case of firmware or software, the implementation may be provided as a computer program product including a non-transitory, computer-readable medium or storage structure embodying computer program code (i.e., software or firmware) thereon for execution by the processor 512. The coded instructions 532 may include program instructions or computer program code that, when executed by the processor 512, may cause the wellsite systems 371-375 to perform methods, processes, and/or routines described herein.

In view of the entirety of the present disclosure, including the figures and the claims, a person having ordinary skill in the art will readily recognize that the present disclosure introduces an apparatus comprising a fluid pumping system comprising: a plurality of pressure exchangers each comprising a fluid inlet, a fluid outlet, and a rotor disposed between the fluid inlet and the fluid outlet and comprising a plurality of fluid chambers extending therethrough, wherein each pressure exchanger is operable to receive a pressurized stream of first fluid into the chambers via the fluid inlet to pressurize and discharge a stream of second fluid out of the chambers via the fluid outlet, wherein the pressurized stream of second fluid discharged via the fluid outlet of each of the pressure exchangers contains pressure oscillations having a frequency based on rotational speed of the corresponding rotor, and wherein the fluid outlets are fluidly connected together to form a combined pressurized stream of second fluid; and a controller comprising a processor and a memory operable to store a computer program code, wherein the controller is operable to control rotational speed and rotational position of the rotor of each of the pressure exchangers to control the frequency and phase of the pressure oscillations within the pressurized stream of second fluid discharged via the fluid outlet of each of the pressure exchangers and thus control amplitude and/or frequency of combined pressure oscillations within the combined pressurized stream of second fluid.

The controller may be operable to control the rotational speed and the rotational position of the rotors of two or more of the pressure exchangers to cause the pressure oscillations within the pressurized streams of second fluid discharged via the fluid outlets of the two or more of the pressure exchangers to be out of phase with respect to each other to reduce the amplitude of the combined pressure oscillations within the combined pressurized stream of second fluid.

The controller may be operable to control the rotational speed and the rotational position of the rotors of two or more of the pressure exchangers to cause the pressure oscillations within the pressurized streams of second fluid discharged via the fluid outlets of the two or more of the pressure exchangers to be in phase with respect to each other to increase the amplitude of the combined pressure oscillations within the combined pressurized stream of second fluid.

The controller may be operable to control the rotational speed and the rotational position of the rotors of two or more of the pressure exchangers to cause the pressure oscillations within the pressurized streams of second fluid discharged via the fluid outlets of the two or more of the pressure exchangers to be: out of phase with respect to each other during a first time period to decrease the amplitude of the combined pressure oscillations within the combined pressurized stream of second fluid; and in phase with respect to each other during a second time period to increase the amplitude of the combined pressure oscillations within the combined pressurized stream of second fluid. The controller may be operable to cause information to be transmitted in the form of the combined pressure oscillations via the combined pressurized stream of second fluid to a downstream pressure sensor by controlling the amplitude and/or frequency of the combined pressure oscillations. Controlling the amplitude and/or frequency of the combined pressure oscillations within the combined pressurized stream of second fluid may comprise alternating between the first and second time periods and/or increasing and decreasing the first and second time periods.

The fluid pumping system may comprise a plurality of motors each connected with the rotor of a corresponding one of the pressure exchangers, and the controller may be operable to control the rotational speed and the rotational position of the motors to control the rotational speed and the rotational position of the rotors. The fluid pumping system may comprise a plurality of position sensors each in signal communication with the controller and associated with a corresponding one of the motors and/or the pressure exchangers. Each of the position sensors may be operable to generate a signal indicative of the rotational speed and/or rotational position of the corresponding one of the rotors, and the controller may be operable to control the rotational speed and the rotational position of each of the rotors based on the signal generated by a corresponding one of the position sensors. Each of the position sensors may comprise an encoder, a rotational position sensor, a rotational speed sensor, a proximity sensor, or a linear position sensor.

The fluid pumping system may comprise a pressure sensor in signal communication with the controller and connected downstream from the fluid outlets of the pressure exchangers, and the pressure sensor may be operable to generate a signal indicative of the combined pressure oscillations within the combined pressurized stream of second fluid.

The fluid pumping system may comprise a plurality of pressure sensors in signal communication with the controller, each of the pressure sensors may be connected at the fluid outlet of a corresponding one of the pressure exchangers, and each of the pressure sensors may be operable to generate a signal indicative of the pressure oscillations within the pressurized stream of second fluid discharged via the fluid outlet of the corresponding one of the pressure exchangers.

The fluid pumping system may comprise a common fluid conduit fluidly connected with the fluid outlets of the pressure exchangers, the common fluid conduit may be fluidly connected with a wellbore extending into a subterranean formation, the combined pressure oscillations may be transmitted into the wellbore within the combined pressurized stream of second fluid, and the combined pressure oscillations may be or comprise tube waves for detecting wellbore features.

The fluid pumping system may comprise a common fluid conduit fluidly connected with the fluid outlets of the pressure exchangers, the common fluid conduit may be fluidly connected with a wellbore extending into a subterranean formation, and the fluid pumping system may be operable to perform mud pulse telemetry by transmitting information to a downhole tool located within the wellbore in the form of the combined pressure oscillations via the combined pressurized stream of second fluid being injected into the wellbore.

The present disclosure also introduces an apparatus comprising a wellsite system operable to inject a dirty fluid into a wellbore extending into a subterranean formation, wherein the wellsite system comprises: (A) a source of a pressurized clean fluid; (B) a source of the dirty fluid; (C) a plurality of pressure exchangers each comprising: (1) a low-pressure fluid inlet; (2) a high-pressure fluid inlet; (3) a high-pressure fluid outlet; and (4) a rotor comprising a plurality of fluid chambers extending therethrough, wherein, as each rotor rotates, each pressure exchanger is operable to: (a) receive the dirty fluid into the chambers via the low-pressure fluid inlet; and (b) receive the pressurized clean fluid into the chambers via the high-pressure fluid inlet to pressurize and discharge the dirty fluid out of the chambers via the high-pressure fluid outlet, wherein the pressurized dirty fluid discharged via the high-pressure fluid outlet of each of the pressure exchangers contains pressure oscillations having a frequency based on rotational speed of the corresponding rotor; (D) a manifold fluidly connecting the high-pressure fluid outlets and configured to combine the pressurized dirty fluid discharged via the high-pressure fluid outlets of the pressure exchangers; (E) a fluid conduit fluidly connecting the manifold with the wellbore and configured to transfer the combined pressurized dirty fluid into the wellbore; and (F) a controller comprising a processor and a memory operable to store a computer program code, wherein the controller is operable to control rotational speed and rotational position of the rotor of each of the pressure exchangers to control the frequency and phase of the pressure oscillations within the pressurized dirty fluid discharged via the high-pressure fluid outlet of each of the pressure exchangers and thus control amplitude and/or frequency of combined pressure oscillations within the combined pressurized dirty fluid.

The dirty fluid may be a fracturing fluid, and the wellsite system may be operable to inject the fracturing fluid into the wellbore during well fracturing operations.

The controller may be operable to control the rotational speed and the rotational position of the rotors of two or more of the pressure exchangers to cause the pressure oscillations within the pressurized dirty fluid discharged via the high-pressure fluid outlets of the two or more of the pressure exchangers to be out of phase with respect to each other to reduce the amplitude of the combined pressure oscillations within the combined pressurized dirty fluid.

The controller may be operable to control the rotational speed and the rotational position of the rotors of two or more of the pressure exchangers to cause the pressure oscillations within the pressurized dirty fluid discharged via the high-pressure fluid outlets of the two or more of the pressure exchangers to be in phase with respect to each other to increase the amplitude of the combined pressure oscillations within the combined pressurized dirty fluid.

The controller may be operable to control the rotational speed and the rotational position of the rotors of two or more of the pressure exchangers to cause the pressure oscillations within the pressurized dirty fluid discharged via the high-pressure fluid outlets of the two or more of the pressure exchangers to be: out of phase with respect to each other during a first time period to decrease the amplitude of the combined pressure oscillations within the combined pressurized dirty fluid; and in phase with respect to each other during a second time period to increase the amplitude of the combined pressure oscillations within the combined pressurized dirty fluid. The controller may be operable to cause information to be transmitted in the form of the combined pressure oscillations via the combined pressurized dirty fluid to a tool located along the fluid conduit or within the wellbore by controlling the amplitude and/or frequency of the combined pressure oscillations. Controlling the amplitude and/or frequency of the combined pressure oscillations within the combined pressurized dirty fluid may comprise alternating between the first and second time periods and/or increasing and decreasing the first and second time periods.

The wellsite system may comprise a plurality of motors each connected with the rotor of a corresponding one of the pressure exchangers, and the controller may be operable to control the rotational speed and the rotational position of the motors to control the rotational speed and the rotational position of the rotors. The wellsite system may comprise a plurality of position sensors each in signal communication with the controller and associated with a corresponding one of the motors and/or the pressure exchangers, each of the position sensors may be operable to generate a signal indicative of the rotational speed and/or rotational position of the corresponding one of the rotors, and the controller may be operable to control the rotational speed and the rotational position of each of the rotors based on the signal generated by a corresponding one of the position sensors. Each of the position sensors may comprise an encoder, a rotational position sensor, a rotational speed sensor, a proximity sensor, or a linear position sensor.

The wellsite system may comprise a pressure sensor in signal communication with the controller and connected along the fluid conduit, and the pressure sensor may be operable to generate a signal indicative of the combined pressure oscillations within the combined pressurized dirty fluid.

The wellsite system may comprise a plurality of pressure sensors in signal communication with the controller, each of the pressure sensors may be connected at the high-pressure fluid outlet of a corresponding one of the pressure exchangers, and each of the pressure sensors may be operable to generate a signal indicative of the pressure oscillations within the pressurized dirty fluid discharged via the high-pressure fluid outlet of the corresponding one of the pressure exchangers.

The combined pressure oscillations may be transmitted into the wellbore within the combined pressurized dirty fluid, and the combined pressure oscillations may be or comprise tube waves for detecting wellbore features.

The wellsite system may be operable to perform mud pulse telemetry by transmitting information to a downhole tool located within the wellbore in the form of the combined pressure oscillations via the combined pressurized dirty fluid being injected into the wellbore.

The present disclosure also introduces a method comprising: operating a plurality of rotary pressure exchangers to pressurize a stream of fluid; injecting the pressurized stream of fluid into a wellbore extending into a subterranean formation; and controlling rotational speed and rotational position of a rotor of each of the pressure exchangers to control amplitude and/or frequency of pressure oscillations within the pressurized stream of fluid being injected into the wellbore.

The fluid may be a fracturing fluid, and injecting the pressurized stream of fluid into the wellbore extending into the subterranean formation may be performed during well fracturing operations.

The method may comprise: forming the stream of fluid; splitting the stream of fluid into individual streams of fluid; directing each individual stream of fluid into a corresponding one of the pressure exchangers, wherein operating the pressure exchangers to pressurize the stream of fluid may comprise pressurizing each individual stream of fluid with a corresponding one of the pressure exchangers, and wherein each pressurized individual stream of fluid may comprise individual pressure oscillations caused by rotation of the rotor of the corresponding one of the pressure exchangers; and combining the pressurized individual streams of fluid into a combined pressurized stream of fluid, wherein controlling the rotational speed and the rotational position of the rotor of each of the pressure exchangers to control the amplitude and/or the frequency of the pressure oscillations within the pressurized stream of fluid being injected into the wellbore may comprise controlling the rotational speed and the rotational position of the rotor of each of the pressure exchangers to control frequency and phase of the individual pressure oscillations within each of the pressurized individual streams of fluid and thus control the amplitude and/or frequency of combined pressure oscillations within the combined pressurized stream of fluid being injected into the wellbore. Controlling the rotational speed and the rotational position of the rotor of each of the pressure exchangers may comprise controlling the rotational speed and the rotational position of the rotors of two or more of the pressure exchangers to cause the pressure oscillations within the pressurized individual streams of fluid of the two or more of the pressure exchangers to be: out of phase with respect to each other to decrease the amplitude of the combined pressure oscillations within the combined pressurized stream of fluid; and in phase with respect to each other to increase the amplitude of the combined pressure oscillations within the combined pressurized stream of fluid. The method may comprise causing information to be transmitted in the form of the combined pressure oscillations via the combined pressurized stream of fluid to a tool located within the wellbore by controlling the amplitude and/or frequency of the combined pressure oscillations.

Controlling the rotational speed and the rotational position of the rotor of each of the pressure exchangers may comprise controlling rotational speed and rotational position of a motor connected with the rotor of each of the pressure exchangers. The method may comprise monitoring the rotational speed and the rotational position of the rotor of each of the pressure exchangers via a plurality of position sensors each associated with a corresponding one of the motors and/or the pressure exchangers, and controlling the rotational speed and the rotational position of the rotor of each of the pressure exchangers may be performed based on a signal generated by each of the position sensors.

The method may comprise transmitting the pressure oscillations into the wellbore along the pressurized stream of fluid being injected into the wellbore, and the pressure oscillations may be or comprise tube waves for detecting wellbore features.

The method may comprise transmitting the pressure oscillations into the wellbore along the pressurized stream of fluid being injected into the wellbore as part of a mud pulse telemetry system.

The foregoing outlines features of several implementations so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the implementations introduced herein. A person having ordinary skill in the art should also realize that such equivalent constructions do not depart from the spirit and scope of the present disclosure, and that they may make various changes, substitutions, and alterations herein without departing from the spirit and scope of the present disclosure.

The Abstract at the end of this disclosure is provided to permit the reader to quickly ascertain the nature of the technical disclosure. It is submitted with the understanding that it will not be used to interpret or limit the scope or meaning of the claims.

What is claimed is:

1. An apparatus comprising:

a fluid pumping system comprising:

a plurality of pressure exchangers each comprising a fluid inlet, a fluid outlet, and a rotor disposed between the fluid inlet and the fluid outlet and comprising a plurality of fluid chambers extending therethrough, wherein each pressure exchanger is operable to receive a pressurized stream of first fluid into the chambers via the fluid inlet to pressurize and discharge a stream of second fluid out of the chambers via the fluid outlet, wherein the pressurized stream of second fluid discharged from each pressure exchanger contains pressure oscillations having a frequency based on rotational speed of the corresponding rotor, and wherein the fluid outlets are fluidly connected together to form a combined pressurized stream of second fluid; and a controller comprising a processor and a memory comprising a computer program code and operable to control rotational speed and position of each rotor to control frequency and phase of the pressure oscillations within the pressurized stream of second fluid discharged from each pressure exchanger, thus controlling amplitude and/or frequency of combined pressure oscillations within the combined pressurized stream of second fluid wherein the controller is operable to control the rotational speed and position of the rotors of two or more of the pressure exchangers to cause the pressure oscillations within the pressurized streams of second fluid discharged from the two or more pressure exchangers to be in phase with respect to each other to increase the amplitude of the combined pressure oscillations within the combined pressurized stream of second fluid.

2. The apparatus of claim 1 wherein the controller is operable to control the rotational speed and position of the rotors of two or more of the pressure exchangers to cause the pressure oscillations within the pressurized streams of second fluid discharged from the two or more pressure exchangers to be out of phase with respect to each other to reduce the amplitude of the combined pressure oscillations within the combined pressurized stream of second fluid.

3. An apparatus comprising:

a fluid pumping system comprising:

a plurality of pressure exchangers each comprising a fluid inlet, a fluid outlet, and a rotor disposed between the fluid inlet and the fluid outlet and comprising a plurality of fluid chambers extending therethrough, wherein each pressure exchanger is operable to receive a pressurized stream of first fluid into the chambers via the fluid inlet to pressurize and discharge a stream of second fluid out of the chambers via the fluid outlet, wherein the pressurized stream of second fluid discharged from each pressure exchanger contains pressure oscillations having a frequency based on rotational speed of the corresponding rotor, and wherein the fluid outlets are fluidly connected together to form a combined pressurized stream of second fluid; and a controller comprising a processor and a memory comprising a computer program code and operable to control rotational speed and position of each rotor to control frequency and phase of the pressure oscillations within the pressurized stream of second fluid discharged from each pressure exchanger, thus controlling amplitude and/or frequency of combined pressure oscillations within the combined pressurized stream of second fluid wherein the controller is further operable to control the rotational speed and the rotational position of the rotors of two or more of the pressure exchangers to cause the pressure oscillations within the pressurized streams of second fluid discharged via the fluid outlets of the two or more of the pressure exchangers to be:

out of phase with respect to each other during a first time period to decrease the amplitude of the combined pressure oscillations within the combined pressurized stream of second fluid; and in phase with respect to each other during a second time period to increase the amplitude of the combined pressure oscillations within the combined pressurized stream of second fluid.

4. The apparatus of claim 3 wherein the controller is further operable to cause information to be transmitted in the form of the combined pressure oscillations via the combined pressurized stream of second fluid to a downstream pressure sensor by controlling the amplitude and/or frequency of the combined pressure oscillations.

5. The apparatus of claim 3 wherein controlling the amplitude and/or frequency of the combined pressure oscillations within the combined pressurized stream of second fluid comprises alternating between the first and second time periods and/or increasing and decreasing the first and second time periods.

6. The apparatus of claim 1 wherein the fluid pumping system further comprises a plurality of motors each connected with the rotor of a corresponding one of the pressure exchangers, and wherein the controller is operable to control the rotational speed and the rotational position of the motors to control the rotational speed and the rotational position of the rotors.

7. The apparatus of claim 6 wherein the fluid pumping system further comprises a plurality of position sensors each in signal communication with the controller and associated with a corresponding one of the motors and/or the pressure exchangers, wherein each of the position sensors is operable to generate a signal indicative of the rotational speed and/or rotational position of the corresponding one of the rotors, and wherein the controller is operable to control the rotational speed and the rotational position of each of the rotors based on the signal generated by a corresponding one of the position sensors.

8. The apparatus of claim 7 wherein each of the position sensors comprises an encoder, a rotational position sensor, a rotational speed sensor, a proximity sensor, or a linear position sensor.

9. The apparatus of claim 1 wherein the fluid pumping system further comprises a pressure sensor in signal communication with the controller and connected downstream from the fluid outlets of the pressure exchangers, and wherein the pressure sensor is operable to generate a signal indicative of the combined pressure oscillations within the combined pressurized stream of second fluid.

10. The apparatus of claim 1 wherein the fluid pumping system further comprises a plurality of pressure sensors in signal communication with the controller, wherein each of the pressure sensors is connected at the fluid outlet of a corresponding one of the pressure exchangers, and wherein each of the pressure sensors is operable to generate a signal indicative of the pressure oscillations within the pressurized stream of second fluid discharged via the fluid outlet of the corresponding one of the pressure exchangers.

11. An apparatus comprising:

a fluid pumping system comprising:

a plurality of pressure exchangers each comprising a fluid inlet, a fluid outlet, and a rotor disposed between the fluid inlet and the fluid outlet and comprising a plurality of fluid chambers extending therethrough, wherein each pressure exchanger is operable to receive a pressurized stream of first fluid into the chambers via the fluid inlet to pressurize and discharge a stream of second fluid out of the chambers via the fluid outlet, wherein the pressurized stream of second fluid discharged from each pressure exchanger contains pressure oscillations having a frequency based on rotational speed of the corresponding rotor, and wherein the fluid outlets are fluidly connected together to form a combined pressurized stream of second fluid; and a controller comprising a processor and a memory comprising a computer program code and operable to control rotational speed and position of each rotor to control frequency and phase of the pressure oscillations within the pressurized stream of second fluid discharged from each pressure exchanger, thus controlling amplitude and/or frequency of combined pressure oscillations within the combined pressurized stream of second fluid wherein the fluid pumping system further comprises a common fluid conduit fluidly connected with the fluid outlets of the pressure exchangers, wherein the common fluid conduit is fluidly connected with a wellbore extending into a subterranean formation, wherein the combined pressure oscillations are transmitted into the wellbore within the combined pressurized stream of second fluid, and wherein the combined pressure oscillations are or comprise tube waves for detecting wellbore features.

12. An apparatus comprising:

a fluid pumping system comprising:

a plurality of pressure exchangers each comprising a fluid inlet, a fluid outlet, and a rotor disposed between the fluid inlet and the fluid outlet and comprising a plurality of fluid chambers extending therethrough, wherein each pressure exchanger is operable to receive a pressurized stream of first fluid into the chambers via the fluid inlet to pressurize and discharge a stream of second fluid out of the chambers via the fluid outlet, wherein the pressurized stream of second fluid discharged from each pressure exchanger contains pressure oscillations having a frequency based on rotational speed of the corresponding rotor, and wherein the fluid outlets are fluidly connected together to form a combined pressurized stream of second fluid; and a controller comprising a processor and a memory comprising a computer program code and operable to control rotational speed and position of each rotor to control frequency and phase of the pressure oscillations within the pressurized stream of second fluid discharged from each pressure exchanger, thus controlling amplitude and/or frequency of combined pressure oscillations within the combined pressurized stream of second fluid wherein the fluid pumping system further comprises a common fluid conduit fluidly connected with the fluid outlets of the pressure exchangers, wherein the common fluid conduit is fluidly connected with a wellbore extending into a subterranean formation, and wherein the fluid pumping system is operable to perform mud pulse telemetry by transmitting information to a downhole tool located within the wellbore in the form of the combined pressure oscillations via the combined pressurized stream of second fluid being injected into the wellbore.

13. An apparatus comprising:

a wellsite system operable to inject a dirty fluid into a wellbore extending into a subterranean formation, wherein the wellsite system comprises:

a source of a pressurized clean fluid;

a source of the dirty fluid;

a plurality of pressure exchangers each comprising a low-pressure fluid inlet, a high-pressure fluid inlet, a high-pressure fluid outlet, and a rotor comprising a plurality of fluid chambers extending therethrough, wherein, as each rotor rotates, each pressure exchanger is operable to:

receive the dirty fluid into the chambers via the low-pressure fluid inlet and receive the pressurized clean fluid into the chambers via the high-pressure fluid inlet to pressurize and discharge the dirty fluid out of the chambers via the high-pressure fluid outlet, wherein the pressurized dirty fluid discharged from each pressure exchanger contains pressure oscillations having a frequency based on rotational speed of the corresponding rotor;

a manifold fluidly connecting the high-pressure fluid outlets and combining the pressurized dirty fluid discharged from the pressure exchangers;

a fluid conduit fluidly connecting the manifold with the wellbore and transferring the combined pressurized dirty fluid into the wellbore; and a controller comprising a processor and a memory comprising a computer program code and operable to control rotational speed and position of each rotor to control frequency and phase of the pressure oscillations within the pressurized dirty fluid discharged from the pressure exchangers to, thus, control amplitude and/or frequency of combined pressure oscillations within the combined pressurized dirty fluid wherein the controller is further operable to control the rotational speed and the rotational position of the rotors of two or more of the pressure exchangers to cause the pressure oscillations within the pressurized dirty fluid discharged via the high-pressure fluid outlets of the two or more of the pressure exchangers to be in phase with respect to each other to increase the amplitude of the combined pressure oscillations within the combined pressurized dirty fluid.

14. The apparatus of claim 13 wherein the dirty fluid is a fracturing fluid, and wherein the wellsite system is operable to inject the fracturing fluid into the wellbore during well fracturing operations.

15. The apparatus of claim 13 wherein the controller is further operable to control the rotational speed and the rotational position of the rotors of two or more of the pressure exchangers to cause the pressure oscillations within the pressurized dirty fluid discharged via the high-pressure fluid outlets of the two or more of the pressure exchangers to be out of phase with respect to each other to reduce the amplitude of the combined pressure oscillations within the combined pressurized dirty fluid.

16. The apparatus of claim 13 wherein the wellsite system further comprises a plurality of motors each connected with the rotor of a corresponding one of the pressure exchangers, and wherein the controller is operable to control the rotational speed and the rotational position of the motors to control the rotational speed and the rotational position of the rotors.

17. The apparatus of claim 16 wherein the wellsite system further comprises a plurality of position sensors each in signal communication with the controller and associated with a corresponding one of the motors and/or the pressure exchangers, wherein each of the position sensors is operable to generate a signal indicative of the rotational speed and/or rotational position of the corresponding one of the rotors, and wherein the controller is operable to control the rotational speed and the rotational position of each of the rotors based on the signal generated by a corresponding one of the position sensors.

18. The apparatus of claim 17 wherein each of the position sensors comprises an encoder, a rotational position sensor, a rotational speed sensor, a proximity sensor, or a linear position sensor.

19. The apparatus of claim 13 wherein the wellsite system further comprises a pressure sensor in signal communication with the controller and connected along the fluid conduit, and wherein the pressure sensor is operable to generate a signal indicative of the combined pressure oscillations within the combined pressurized dirty fluid.

20. The apparatus of claim 13 wherein the wellsite system further comprises a plurality of pressure sensors in signal communication with the controller, wherein each of the pressure sensors is connected at the high-pressure fluid outlet of a corresponding one of the pressure exchangers, and wherein each of the pressure sensors is operable to generate a signal indicative of the pressure oscillations within the pressurized dirty fluid discharged via the high-pressure fluid outlet of the corresponding one of the pressure exchangers.

21. An apparatus comprising:

a wellsite system operable to inject a dirty fluid into a wellbore extending into a subterranean formation, wherein the wellsite system comprises:

a source of a pressurized clean fluid;

a source of the dirty fluid;

a plurality of pressure exchangers each comprising a low-pressure fluid inlet, a high-pressure fluid inlet, a high-pressure fluid outlet, and a rotor comprising a plurality of fluid chambers extending therethrough, wherein, as each rotor rotates, each pressure exchanger is operable to:

receive the dirty fluid into the chambers via the low-pressure fluid inlet and receive the pressurized clean fluid into the chambers via the high-pressure fluid inlet to pressurize and discharge the dirty fluid out of the chambers via the high-pressure fluid outlet, wherein the pressurized dirty fluid discharged from each pressure exchanger contains pressure oscillations having a frequency based on rotational speed of the corresponding rotor;

a manifold fluidly connecting the high-pressure fluid outlets and combining the pressurized dirty fluid discharged from the pressure exchangers;

a fluid conduit fluidly connecting the manifold with the wellbore and transferring the combined pressurized dirty fluid into the wellbore; and a controller comprising a processor and a memory comprising a computer program code and operable to control rotational speed and position of each rotor to control frequency and phase of the pressure oscillations within the pressurized dirty fluid discharged from the pressure exchangers to, thus, control amplitude and/or frequency of combined pressure oscillations within the combined pressurized dirty fluid wherein the controller is further operable to control the rotational speed and the rotational position of the rotors of two or more of the pressure exchangers to cause the pressure oscillations within the pressurized dirty fluid discharged via the high-pressure fluid outlets of the two or more of the pressure exchangers to be:

out of phase with respect to each other during a first time period to decrease the amplitude of the combined pressure oscillations within the combined pressurized dirty fluid; and in phase with respect to each other during a second time period to increase the amplitude of the combined pressure oscillations within the combined pressurized dirty fluid.

22. The apparatus of claim 21 wherein the controller is further operable to cause information to be transmitted in the form of the combined pressure oscillations via the combined pressurized dirty fluid to a tool located along the fluid conduit or within the wellbore by controlling the amplitude and/or frequency of the combined pressure oscillations.

23. The apparatus of claim 21 wherein controlling the amplitude and/or frequency of the combined pressure oscillations within the combined pressurized dirty fluid comprises alternating between the first and second time periods and/or increasing and decreasing the first and second time periods.

24. An apparatus comprising:

a wellsite system operable to inject a dirty fluid into a wellbore extending into a subterranean formation, wherein the wellsite system comprises:

a source of a pressurized clean fluid;

a source of the dirty fluid;

a plurality of pressure exchangers each comprising a low-pressure fluid inlet, a high-pressure fluid inlet, a high-pressure fluid outlet, and a rotor comprising a plurality of fluid chambers extending therethrough, wherein, as each rotor rotates, each pressure exchanger is operable to:

receive the dirty fluid into the chambers via the low-pressure fluid inlet and receive the pressurized clean fluid into the chambers via the high-pressure fluid inlet to pressurize and discharge the dirty fluid out of the chambers via the high-pressure fluid outlet, wherein the pressurized dirty fluid discharged from each pressure exchanger contains pressure oscillations having a frequency based on rotational speed of the corresponding rotor;

a manifold fluidly connecting the high-pressure fluid outlets and combining the pressurized dirty fluid discharged from the pressure exchangers;

a fluid conduit fluidly connecting the manifold with the wellbore and transferring the combined pressurized dirty fluid into the wellbore; and a controller comprising a processor and a memory comprising a computer program code and operable to control rotational speed and position of each rotor to control frequency and phase of the pressure oscillations within the pressurized dirty fluid discharged from the pressure exchangers to, thus, control amplitude and/or frequency of combined pressure oscillations within the combined pressurized dirty fluid wherein the combined pressure oscillations are transmitted into the wellbore within the combined pressurized dirty fluid, and wherein the combined pressure oscillations are or comprise tube waves for detecting wellbore features.

25. An apparatus comprising:

a wellsite system operable to inject a dirty fluid into a wellbore extending into a subterranean formation, wherein the wellsite system comprises:

a source of a pressurized clean fluid;

a source of the dirty fluid;

a plurality of pressure exchangers each comprising a low-pressure fluid inlet, a high-pressure fluid inlet, a high-pressure fluid outlet, and a rotor comprising a plurality of fluid chambers extending therethrough, wherein, as each rotor rotates, each pressure exchanger is operable to:

receive the dirty fluid into the chambers via the low-pressure fluid inlet and receive the pressurized clean fluid into the chambers via the high-pressure fluid inlet to pressurize and discharge the dirty fluid out of the chambers via the high-pressure fluid outlet, wherein the pressurized dirty fluid discharged from each pressure exchanger contains pressure oscillations having a frequency based on rotational speed of the corresponding rotor;

a manifold fluidly connecting the high-pressure fluid outlets and combining the pressurized dirty fluid discharged from the pressure exchangers;

a fluid conduit fluidly connecting the manifold with the wellbore and transferring the combined pressurized dirty fluid into the wellbore; and a controller comprising a processor and a memory comprising a computer program code and operable to control rotational speed and position of each rotor to control frequency and phase of the pressure oscillations within the pressurized dirty fluid discharged from the pressure exchangers to, thus, control amplitude and/or frequency of combined pressure oscillations within the combined pressurized dirty fluid wherein the wellsite system is operable to perform mud pulse telemetry by transmitting information to a downhole tool located within the wellbore in the form of the combined pressure oscillations via the combined pressurized dirty fluid being injected into the wellbore.

26. A method comprising:

operating a plurality of rotary pressure exchangers to pressurize a stream of fluid;

injecting the pressurized stream of fluid into a wellbore extending into a subterranean formation;

controlling rotational speed and rotational position of a rotor of each of the pressure exchangers to control amplitude and/or frequency of pressure oscillations within the pressurized stream of fluid being injected into the wellbore; and transmitting the pressure oscillations into the wellbore along the pressurized stream of fluid being injected into the wellbore, wherein the pressure oscillations are or comprise tube waves for detecting wellbore features.

27. The method of claim 26 wherein the fluid is a fracturing fluid, and wherein injecting the pressurized stream of fluid into the wellbore extending into the subterranean formation is performed during well fracturing operations.

28. A method comprising:

operating a plurality of rotary pressure exchangers to pressurize a stream of fluid;

injecting the pressurized stream of fluid into a wellbore extending into a subterranean formation;

controlling rotational speed and rotational position of a rotor of each of the pressure exchangers to control amplitude and/or frequency of pressure oscillations within the pressurized stream of fluid being injected into the wellbore; and transmitting the pressure oscillations into the wellbore along the pressurized stream of fluid being injected into the wellbore as part of a mud pulse telemetry system.

29. The method of claim 28 further comprising:

forming the stream of fluid;

splitting the stream of fluid into individual streams of fluid;

directing each individual stream of fluid into a corresponding one of the pressure exchangers, wherein operating the pressure exchangers to pressurize the stream of fluid comprises pressurizing each individual stream of fluid with a corresponding one of the pressure exchangers, and wherein each pressurized individual stream of fluid comprises individual pressure oscillations caused by rotation of the rotor of the corresponding one of the pressure exchangers; and combining the pressurized individual streams of fluid into a combined pressurized stream of fluid, wherein controlling the rotational speed and rotational position of the rotor of each of the pressure exchangers to control the amplitude and/or the frequency of the pressure oscillations within the pressurized stream of fluid being injected into the wellbore comprises controlling the rotational speed and the rotational position of the rotor of each of the pressure exchangers to control frequency and phase of the individual pressure oscillations within each of the pressurized individual streams of fluid and thus control the amplitude and/or frequency of combined pressure oscillations within the combined pressurized stream of fluid being injected into the wellbore.

30. The method of claim 29 wherein controlling the rotational speed and the rotational position of the rotor of each of the pressure exchangers comprises controlling the rotational speed and the rotational position of the rotors of two or more of the pressure exchangers to cause the pressure oscillations within the pressurized individual streams of fluid of the two or more of the pressure exchangers to be:

out of phase with respect to each other to decrease the amplitude of the combined pressure oscillations within the combined pressurized stream of fluid; and in phase with respect to each other to increase the amplitude of the combined pressure oscillations within the combined pressurized stream of fluid.

31. The method of claim 29 further comprising causing information to be transmitted in the form of the combined pressure oscillations via the combined pressurized stream of fluid to a tool located within the wellbore by controlling the amplitude and/or frequency of the combined pressure oscillations.

32. The method of claim 28 wherein controlling the rotational speed and the rotational position of the rotor of each of the pressure exchangers comprises controlling rotational speed and rotational position of a motor connected with the rotor of each of the pressure exchangers.

33. The method of claim 32 further comprising monitoring the rotational speed and the rotational position of the rotor of each of the pressure exchangers via a plurality of position sensors each associated with a corresponding one of the motors and/or the pressure exchangers, and wherein controlling the rotational speed and the rotational position of the rotor of each of the pressure exchangers is performed based on a signal generated by each of the position sensors.

* * * * *